US011447904B2

(12) United States Patent
Im et al.

(10) Patent No.: US 11,447,904 B2
(45) Date of Patent: Sep. 20, 2022

(54) ARTIFICIAL INTELLIGENCE WASHING MACHINE AND METHOD OF CONTROLLING THE SAME

(71) Applicant: LG Electronics Inc., Seoul (KR)

(72) Inventors: Myunghun Im, Seoul (KR); Hwanjin Jung, Seoul (KR); Seonhwa Yu, Seoul (KR); Sunggyun Kim, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 462 days.

(21) Appl. No.: 16/557,947

(22) Filed: Aug. 30, 2019

(65) Prior Publication Data

US 2020/0109504 A1 Apr. 9, 2020

(30) Foreign Application Priority Data

Aug. 30, 2018 (KR) ..... 10-2018-0103083
Aug. 7, 2019 (KR) ..... 10-2019-0096303

(51) Int. Cl.

*D06F 33/00* (2020.01)
*D06F 34/18* (2020.01)
*D06F 33/36* (2020.01)
*D06F 103/46* (2020.01)

(52) U.S. Cl.

CPC ..... *D06F 33/00* (2013.01); *D06F 33/36* (2020.02); *D06F 34/18* (2020.02); *D06F 2103/46* (2020.02)

(58) Field of Classification Search

CPC ..... D06F 33/00
See application file for complete search history.

(56) References Cited

U.S. PATENT DOCUMENTS

2011/0202303 A1 8/2011 Petronilho et al.

FOREIGN PATENT DOCUMENTS

| | | |
|---|---|---|
| CN | 102720037 | 10/2012 |
| CN | 103628275 | 3/2014 |
| CN | 103717797 | 4/2014 |
| CN | 105040353 | 11/2015 |
| CN | 106854808 | 6/2017 |
| EP | 2473661 | 7/2012 |
| EP | 2719812 | 4/2014 |
| GB | 2253496 | 9/1992 |
| JP | H02154793 | 6/1990 |

(Continued)

OTHER PUBLICATIONS

European Office Action in European Appln. No. 19 194 605.2, dated Nov. 23, 2020, 4 pages.

(Continued)

*Primary Examiner* — Jason Y Ko
(74) *Attorney, Agent, or Firm* — Fish & Richardson P.C.

(57) ABSTRACT

Disclosed is a method of controlling a washing machine, the method including determining the state of laundry received in a washing tub from output of an output layer of an artificial neural network pre-trained based on machine learning using a current value supplied to a motor configured to rotate the washing tub during accelerated rotation of the washing tub as input data of an input layer of the artificial neural network (a first sensing step), selecting one of a plurality of washing modes classified in consideration of the wear degree of laundry or washing strength based on the state of the laundry, and performing washing according to the selected washing mode (a washing cycle step).

17 Claims, 14 Drawing Sheets

(56) References Cited

FOREIGN PATENT DOCUMENTS

| | | |
|---|---|---|
| JP | H04256790 | 9/1992 |
| JP | H04325194 | 11/1992 |
| KR | 1020110023062 | 3/2011 |
| KR | 101841248 | 3/2018 |
| WO | WO2011025339 | 3/2011 |

OTHER PUBLICATIONS

PCT International Search Report in International Appln. No. PCT/KR2019/011224, dated Aug. 30, 2019, 6 pages (with English translation).

Naver blog, [online] "Addwash WF19N8750KW Samsung Electronic Land," Samsung Electronics, Mar. 2018, retrieved from https://m.blog.naver.com/PostView.nhn?blogId=etland_hni&logNo=221236329600&proxyReferer=https%3A%2F%2Fwww.google.com%2F, 4 pages.

CN Office Action in Chinese Appln. No. 201910813049.1, dated May 8, 2021, 15 pages (with English translation).

Office Action in European Appln. No. 19194605.2, dated Sep. 15, 2021, 5 pages.

ARTIFICIAL INTELLIGENCE WASHING MACHINE AND METHOD OF CONTROLLING THE SAME

CROSS-REFERENCE TO RELATED APPLICATION

This application claims the benefit of priority to Korean Application No. 10-2019-0096303, filed on Aug. 7, 2019, and Korean Application No. 10-2018-0103083, filed Aug. 30, 2018, the contents of which is hereby incorporated by reference in its entirety.

BACKGROUND OF THE INVENTION

Field of the Invention

The present invention relates to a washing machine and a method of controlling the same, and more particularly to a washing machine that senses laundry weight and laundry quality based on machine learning and a method of controlling the same.

Description of the Related Art

In general, a washing machine is an apparatus that removes contaminants from clothing, bedding, etc. (hereinafter, simply referred to as 'laundry') using a chemical decomposition action of water and detergent and a physical action, such as friction, between water and laundry, The washing machine is mainly classified as an agitator type washing machine, a pulsator type washing machine, or a drum type washing machine. The drum type washing machine includes a water storage tub for storing water and a washing tub rotatably provided in the water storage tub for receiving laundry. A plurality of through-holes, through which water flows, is formed in the washing tub. A washing operation is generally divided into a washing cycle, a rinsing cycle, and a spin-drying cycle.

During the washing cycle, contaminants are removed from laundry using frictional force between the water stored in the water storage tub and the laundry stored in the washing tub and a chemical action of detergent contained in the water.

During the rinsing cycle, water having no detergent dissolved therein is supplied into the water storage tub in order to rinse the laundry. In particular, the detergent absorbed into the laundry during the washing cycle is removed. During the rinsing cycle, a fabric softener may be supplied together with water.

During the spin-drying cycle, the washing tub is rotated at a high speed in order to spin-dry the laundry after the rinsing cycle is completed. In general, the overall operation of the washing machine is finished when the spin-drying cycle is completed. In the case of a washing machine having a drying function, however, a drying cycle may be further performed after the spin-drying cycle is completed.

In general, the washing operation is set depending on the weight of laundry introduced into the washing tub (hereinafter, also referred to as "laundry weight"). For example, water supply level, washing strength, drainage time, and spin-drying time are set depending on the laundry weight.

Variation in washing performance occurs depending on the kind of laundry (hereinafter, also referred to as "laundry quality") as well as the laundry weight. In the case in which the washing operation is set in consideration of the laundry weight alone, therefore, sufficient washing performance may not be expected.

In addition, the damage degree of laundry varies depending on the kind of laundry even when the same washing operation is performed. In the case in which the washing operation is set in consideration of the laundry weight alone, therefore, the laundry may be damaged.

Classification, regression, and clustering models based on statistics are located in the center of conventional machine learning. Particularly, in supervised learning of the classification and regression models, a person defines, in advance, characteristics of learning data and a learning model that distinguishes between new data based on the characteristics. Unlike this, deep learning is a computer finding and distinguishing between characteristics by itself.

One of the factors that accelerate the growth of deep learning is an open source deep learning framework. For example, examples of the deep learning framework include Theano from Montreal University in Canada, Torch from New York University in USA, Caffe from University of California, Berkeley in USA, and TensorFlow from Google.

As the deep learning framework is open, a learning process, a learning method, and extraction and selection of data used for learning become further important for effective learning and recognition in addition to a deep learning algorithm.

In addition, research on the use of artificial intelligence and machine learning in various kinds of products and services has been increasingly conducted.

Korean Registered Patent No. 10-1841248 (hereinafter, also referred to as "conventional art") discloses a control method of sensing laundry weight using the speed of a motor as input data of an artificial neural network pre-trained based on machine learning.

In the conventional art, however, only the laundry weight is sensed, whereby washing performance may be deteriorated and laundry may be damaged.

SUMMARY OF THE INVENTION

It is an object of the present invention to provide a washing machine capable of rapidly and accurately sensing laundry weight and/or laundry quality based on machine learning and a method of controlling the same.

It is another object of the present invention to provide a washing machine capable of efficiently processing data used to determine laundry weight and/or laundry quality in order to reduce time necessary for determination and a method of controlling the same.

It is another object of the present invention to provide a washing machine capable of classifying laundry based on various criteria, such as the softness/hardness of the laundry, the water content of the laundry, and the volumetric difference between dry laundry and wet laundry, and a method of controlling the same.

It is a further object of the present invention to provide a washing machine capable of reducing damage to laundry and improving washing performance in consideration of the state of the laundry (the material, hardness, water content, and composition of the laundry) and a method of controlling the same.

The objects of the present invention are not limited to the above-mentioned object, and other objects that have not been mentioned above will become evident to those skilled in the art from the following description.

In accordance with an aspect of the present invention, the above and other objects can be accomplished by the provision of a method of controlling a washing machine, the method including a first sensing step of determining the state of laundry received in a washing tub.

At the first sensing step, the state of the laundry received in the washing tub may be determined from output of an output layer of an artificial neural network pre-trained based on machine learning using a current value supplied to a motor configured to rotate the washing tub during accelerated rotation of the washing tub as input data of an input layer of the artificial neural network.

The first sensing step may include a first acceleration step of rotating the washing tub while accelerating the washing tub, a step of obtaining a first current value that is supplied to the motor in a first acceleration period in which the washing tub is rotated while being accelerated, and a step of determining the state of the laundry from the output of the output layer of the artificial neural network using the first current value as the input data.

The first sensing step may include a step of determining the state of the laundry to be one of a plurality of laundry quality steps classified in consideration of the hardness of laundry.

The first sensing step may include a step of obtaining the weight of the laundry received in the washing tub from the output of the output layer of the artificial neural network using the current value as the input data.

The method may further include a second sensing step of redetermining the state of the laundry received in the washing tub using the artificial neural network after the first sensing step.

At the second sensing step, the washing tub may be accelerated again, and the state of the laundry received in the washing tub may be determined from the output of an output layer of the artificial neural network using a current value supplied to the motor that rotates the washing tub as the input data of the input layer of the artificial neural network.

The second sensing step may include a second acceleration step of rotating the washing tub while accelerating the washing tub, a step of obtaining a second current value supplied to the motor in a second acceleration period in which the washing tub is rotated while being accelerated, and a step of determining the state of the laundry from the output of the output layer of the artificial neural network using the second current value as the input data of the artificial neural network.

Each of the first and second sensing steps may further include a step of sensing the rotational speed of the washing tub.

Each of the first and second acceleration steps may further include a step of accelerating the washing tub from a first rotational speed to a second rotational speed, which is higher than the first rotational speed.

The second rotational speed may be a rotational speed at which the laundry is rotated integrally with the washing tub. The second rotational speed may be a rotational speed at which the laundry in the washing tub is rotated in the state of clinging to the washing tub without being dropped from the highest point of the washing tub. The second rotational speed may be a rotational speed at which centrifugal force applied to the laundry due to the rotation of the washing tub is greater than gravity applied to the laundry.

The second rotational speed may be 60 to 80 rpm.

The first rotational speed may be 10 to 20 rpm.

The step of accelerating the washing tub may include a step of accelerating the rotational speed of the motor at a uniform acceleration from a first rotational speed to a second rotational speed.

Each of the first and second sensing steps may include a step of selecting a current value corresponding to a period in which the rotational speed of the washing tub is accelerated from the first rotational speed to the second rotational speed from among current values obtained at the step of obtaining the current value based on the sensed speed value and a step of using the selected current value as the input data.

Each of the first and second sensing steps may include a step of using a current value supplied to the motor in a period in which the rotational speed of the washing tub 4 is accelerated from the first rotational speed to the second rotational speed, which is higher than the first rotational speed, as the input data.

The method may further include a step of obtaining the state of the laundry based on first laundry quality, which is the state of the laundry determined at the first sensing step, and second laundry quality, which is the state of the laundry determined at the second sensing step, after the second sensing step.

The method may further include a laundry weight sensing step of obtaining the weight of the laundry received in the washing tub before the first sensing step.

The method may include a washing cycle step of performing washing according to a washing mode constructed based on the state of the laundry.

The method may include a step of selecting one of a plurality of washing modes based on the state of the laundry and a washing cycle step of performing washing according to the selected washing mode.

The washing modes may be classified in consideration of the wear degree of the laundry and/or washing strength.

The step of selecting the washing mode may include a step of selecting the washing mode based on the state of the laundry obtained based on the first laundry quality and the second laundry quality.

In the washing mode, the rotational speed of the washing tub may be set based on the state of the laundry. In the washing mode, the rotational speed of the washing tub may be set to be lower in the case in which the state of the laundry is harder.

In the washing mode, the amount of wash water that is supplied to the washing tub may be set based on the state of the laundry and the weight of the laundry. The washing cycle step may include a water supply step of supplying the predetermined amount of wash water to the washing tub. In the case in which the weight of the laundry is increased, the predetermined amount of wash water may be set to a larger amount than a reference amount of water supply. In the case in which the state of the laundry is harder, the predetermined amount of wash water may be set to a smaller amount than the reference amount of water supply.

In the washing mode, washing cycle time may be set based on the state of the laundry and the weight of the laundry. At the washing cycle step, washing may be performed for the predetermined time. The washing cycle time may be set to be longer in the case in which the state of the laundry is harder.

In the washing mode, the temperature of wash water that is supplied to the washing tub may be set based on the state of the laundry. The temperature of wash water that is supplied to the washing tub may be set to be higher in the case in which the state of the laundry is harder.

In the washing mode, a net acting ratio of washing may be set based on the state of the laundry. The net acting ratio of washing may be defined as a ratio of time during which the motor is operated at the washing cycle step to the washing cycle time.

The washing cycle step may include a step of operating a pump configured to circulate wash water such that the wash water is sprayed into the washing tub through a nozzle. In the washing mode, a net acting ratio of circulation may be set based on the state of the laundry. The net acting ratio of circulation may be defined as a ratio of time during which the pump is operated at the washing cycle step to the washing cycle time.

In accordance with another aspect of the present invention, there is provided a washing machine configured to perform the method.

The washing machine may include a washing tub configured to receive laundry, the washing tub being configured to be rotatable, a motor configured to rotate the washing tub, a controller configured to control the motor such that the washing tub is rotated, and a current sensing unit configured to sense current supplied to the motor.

The controller may be configured to obtain the weight of the laundry and the state of the laundry from output of an output layer of an artificial neural network using a current value sensed by the current sensing unit during accelerated rotation of the washing tub as input data of an input layer of the artificial neural network. The artificial neural network may be pre-trained based on machine learning.

The controller may perform a washing cycle based on the weight of the laundry and the state of the laundry obtained from the output of the artificial neural network.

The details of other embodiments are included in the following description and the accompanying drawings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, embodiments of the present invention will be described with reference to the accompanying drawings. However, the present invention is not limited to the following embodiments and may be implemented in various different forms.

Parts that are not related to the description of the present invention will be omitted from the drawings in order to clearly and briefly describe the present invention. Wherever possible, the same reference numbers will be used throughout the specification to refer to the same or like elements.

Meanwhile, the terms "module" and "unit," when attached to the names of components, are used herein merely for convenience of description, and thus they should not be considered as having specific meanings or roles. Accordingly, the terms "module" and "unit" may be used interchangeably.

Figure 1:
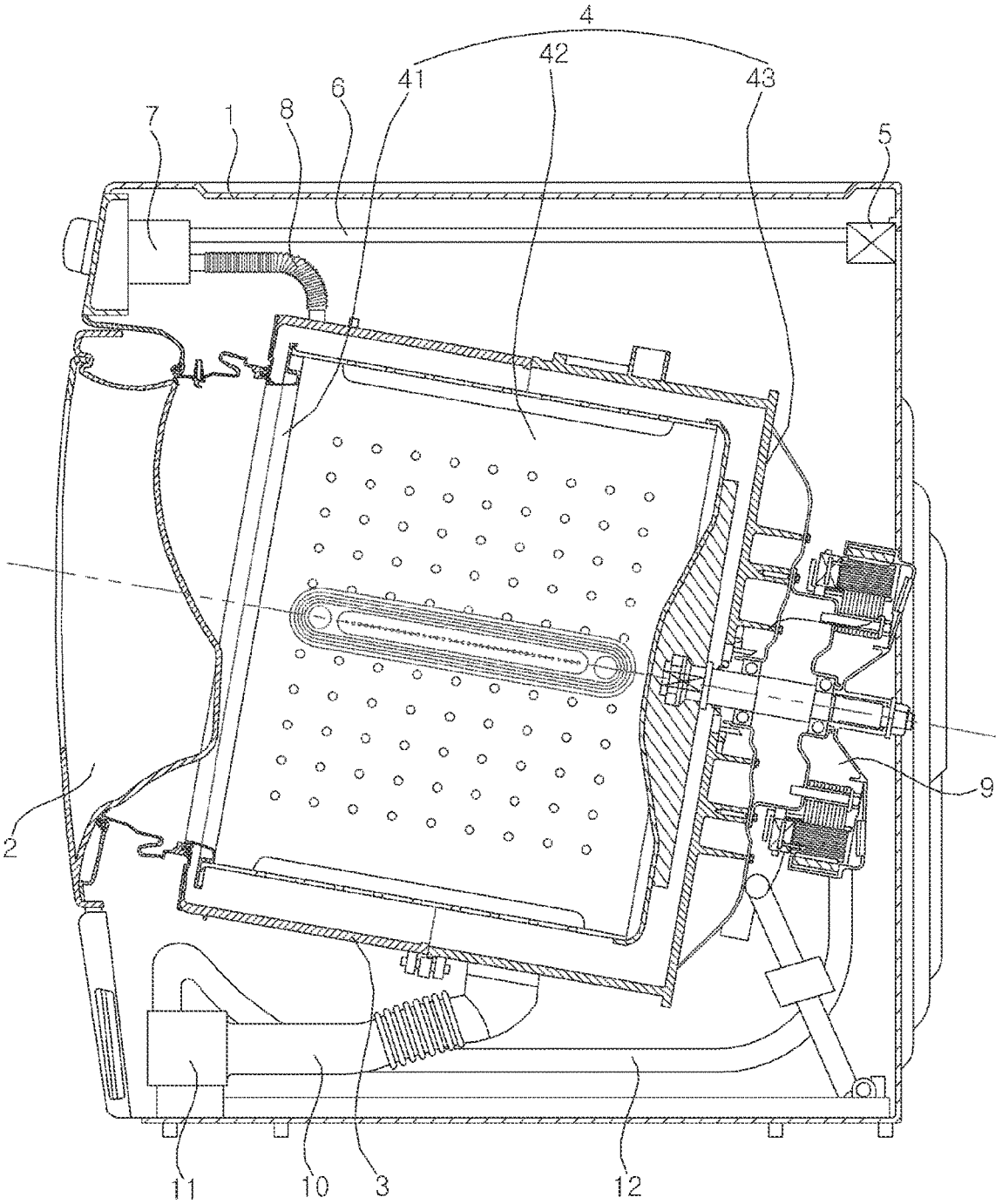
FIG. 1 is a sectional view showing a washing machine according to an embodiment of the present invention.
Figure 2:
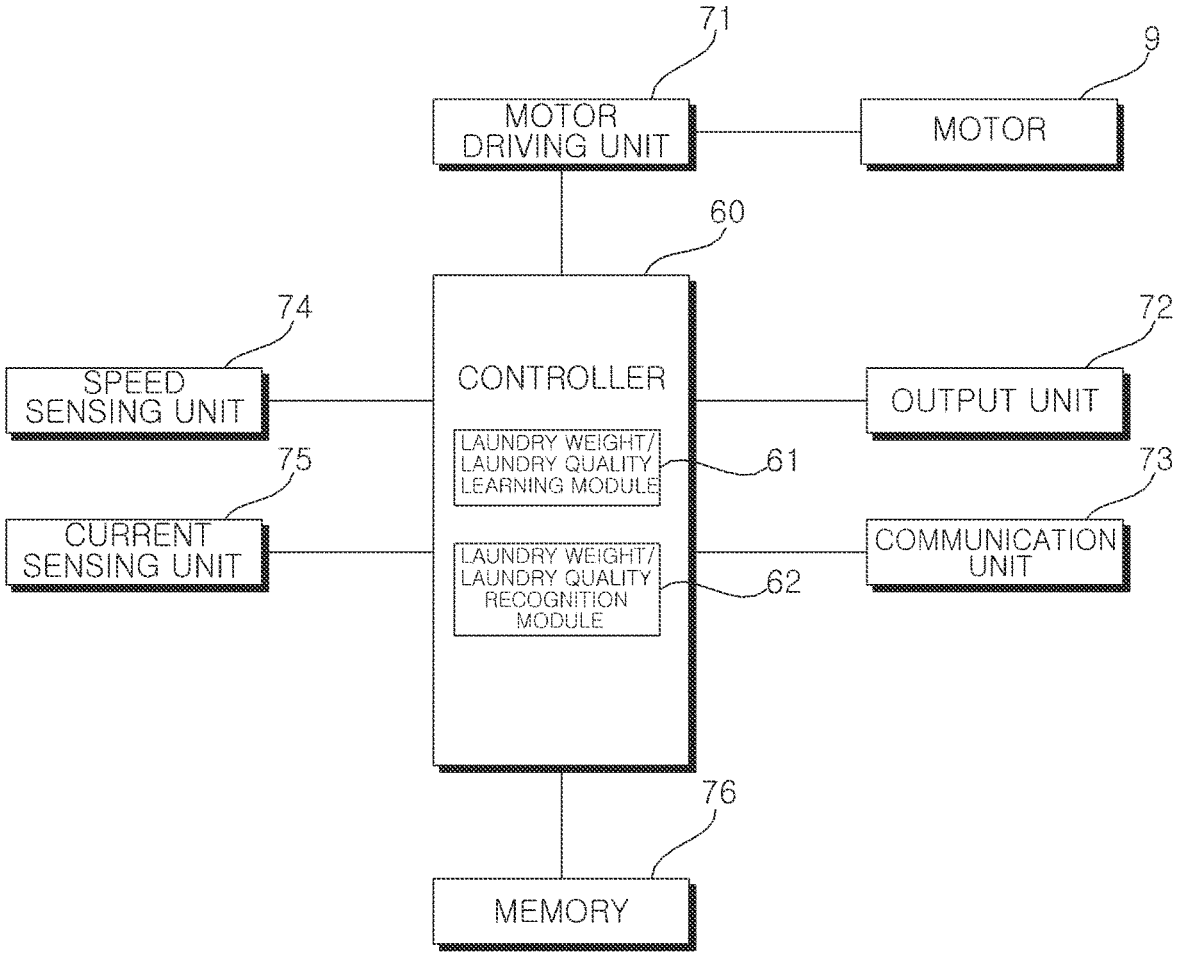
FIG. 2 is a block diagram showing a control relationship between main components of the washing machine of FIG. 1.

FIG. 1 is a sectional view showing a washing machine according to an embodiment of the present invention. FIG. 2 is a block diagram showing a control relationship between main components of the washing machine according to the embodiment of the present invention.

Referring to FIG. 1, the washing machine according to the embodiment of the present invention includes a casing 1, which defines the external appearance thereof, a water storage tub 3 disposed in the casing 1 for storing wash water, a washing tub 4 rotatably installed in the water storage tub 3, laundry being introduced into the washing tub 4, and a motor 9 for rotating the washing tub 4.

The washing tub 4 includes a front cover 41 having therein an opening through which laundry is introduced and removed, a cylindrical drum 42 disposed approximately horizontally, the front end of the cylindrical drum 42 being coupled to the front cover 41, and a rear cover 43 coupled to the rear end of the drum 42. A rotary shaft of the motor 9 may be connected to the rear cover 43 through a rear wall of the water storage tub 3. A plurality of through-holes may be formed in the drum 42 such that water flows between the washing tub 4 and the water storage tub 3.

A lifter 20 may be provided at the inner circumferential surface of the drum 42. The lifter 20 may be formed so as to protrude from the inner circumferential surface of the drum 42, and may extend in the longitudinal direction (the forward-rearward direction) of the drum 42. A plurality of lifters 20 may be arranged in the circumferential direction of the drum 42 so as to be spaced apart from each other. When the washing tub 4 is rotated, laundry may be lifted up by the lifters 20.

The washing tub 4 is rotated about a horizontal axis. Here, "horizontality" does not mean geometric horizontality in the strict sense of the word. Even in the case in which the washing tub 4 is inclined at a predetermined angle to the horizontality, as shown in FIG. 1, the inclination of the washing tub 4 is approximate to the horizontality, rather than the verticality. Hereinafter, therefore, the washing tub 4 will be described as being rotated about the horizontal axis.

A laundry introduction port is formed in the front surface of the casing 1, and a door 2 for opening and closing the laundry introduction port is hinged to the casing 1. A water supply valve 5, a water supply pipe 6, and a water supply hose 8 may be installed in the casing 1. When the water supply valve 5 is opened in order to supply water, wash water passing through the water supply pipe 6 is mixed with detergent in a dispenser 7, and is then supplied to the water storage tub 3 through the water supply hose 8.

An input port of a pump 11 is connected to the water storage tub 3 via a discharge hose 10, and a discharge port of the pump 11 is connected to a discharge pipe 12. Water discharged from the water storage tub 3 through the discharge hose 10 is driven along the discharge pipe 12 by the pump 11, and is then discharged out of the washing machine.

Referring to FIG. 2, the washing machine according to the embodiment of the present invention may include a controller 60 for controlling the overall operation of the washing machine, an input unit 77, a motor driving unit 71, an output unit 72, a communication unit 73, a speed sensing unit 74, a current sensing unit 75, and a memory 76, all of which are controlled by the controller 60.

The controller 60 may control a series of washing processes, such as washing, rinsing, spin drying, and drying. The controller 60 may receive a series of washing processes, such as washing, rinsing, spin drying, and drying, from a user through the input unit 77. The controller 60 may perform washing and rinsing cycles according to a predetermined algorithm. In addition, the controller 60 may control the motor driving unit 71 according to the algorithm.

The motor driving unit 71 may control driving of the motor 9 in response to a control signal from the control unit 60. The control signal may be a signal for controlling the target speed, the accelerated gradient (or acceleration), the driving time, etc. of the motor 9.

The motor driving unit 71, which drives the motor 9, may include an inverter (not shown) and an inverter controller (not shown). In addition, the motor driving unit 71 may be a concept further including a converter for supplying direct-current power that is input to the inverter.

For example, in the case in which the inverter controller (not shown) outputs a pulse with modulation (PWM) type switching control signal to the inverter (not shown), the inverter (not shown) may perform a high-speed switching operation in order to supply alternating-current power having a predetermined frequency to the motor 9.

The speed sensing unit 74 senses the rotational speed of the washing tub 4. The speed sensing unit 74 may sense the rotational speed of a rotor of the motor 9. In the case in which planetary gear trains, which convert the rotation ratio of the motor 9 in order to rotate the washing tub 4, are provided, the rotational speed of the washing tub 4 may be a value acquired by converting the rotational speed of the rotor sensed by the speed sensing unit 74 in consideration of the deceleration or acceleration ratio of the planetary gear trains.

The controller 60 may control the motor driving unit 71 such that the motor follows the predetermined target speed using the present speed transmitted from the speed sensing unit 74 as feedback.

The current sensing unit 75 may sense current that is supplied to the motor (hereinafter referred to as present current), and may transmit the sensed present current to the controller 60. The controller 60 may sense laundry weight and laundry quality using the received present current as input data. At this time, present current values as the input data include values acquired while the motor 9 is accelerated to the predetermined target speed.

In the case in which the rotation of the motor 9 is controlled through vector control based on torque current and flux current, the present current may be a torque-axis (q-axis) component of current flowing in a motor circuit, i.e. torque current Iq.

The output unit 72 outputs the operation state of the washing machine. The output unit 72 may be an image output device that outputs a visual display, such as an LCD or an LED, or a sound output device that outputs sound, such as a speaker or a buzzer. The output unit 72 may output information about the laundry weight or the laundry quality under the control of the controller 60.

The memory 76 may store a programmed artificial neural network, patterns of current by laundry weight and/or by laundry quality, a database (DB) constructed through machine-learning-based training based on the patterns of current, a machine learning algorithm, present current values sensed by the current sensing unit 75, an average of the present current values, a value acquired by processing the average according to a parsing rule, and data transmitted and received through the communication unit 73.

In addition, the memory 76 may store various control data for controlling the overall operation of the washing machine, washing setting data input by a user, washing time calculated according to washing setting, data about a washing course, and data for determining whether an error occurs in the washing machine.

The communication unit 73 may communicate with a server connected to a network. The communication unit 73 may include one or more communication modules, such as an Internet module and a mobile communication module. The communication unit 73 may receive various data, such as learning data and algorithm update, from the server.

The controller 60 may process various data received through the communication unit 73 in order to update the memory 76. For example, in the case in which data input through the communication unit 73 are update data about an operation program stored in the memory 76 in advance, the controller 60 may update the memory 76 using the same. In the case in which the input data are a new operation program, the controller 60 may further store the same in the memory 76.

Deep learning is a method of teaching a human's way of thinking to a computer based on an artificial neural network (ANN) for constructing artificial intelligence, and is artificial intelligence technology enabling the computer to autonomously learn like a human although the human does not teach the computer. The artificial neural network (ANN) may be realized in the form of software or hardware, such as a chip.

The washing machine may process current values sensed by the current sensing unit 75 in order to grasp the characteristics of laundry introduced into the washing tub 4 (hereinafter referred to as laundry characteristics) based on machine learning. Examples of the laundry characteristics may include the weight of laundry and the state of laundry (hereinafter, also referred to as "laundry quality"). The controller 60 may determine laundry quality by laundry weight based on machine learning. For example, the controller 60 may acquire laundry weight, and may determine one of previously classified categories to which laundry belongs based on laundry quality. The state of laundry may be defined based on various factors, such as the material of laundry, the softness of laundry (e.g. soft laundry/hard laundry), the ability of laundry to contain water (i.e. water content), the volumetric difference between dry laundry and wet laundry, and the composition of laundry (i.e. the mixing ratio of soft laundry to hard laundry).

The controller 60 may sense laundry weight using the present current value sensed by the current sensing unit 75 until the target speed is reached as input data of the artificial neural network previously trained through machine learning.

Figure 3:
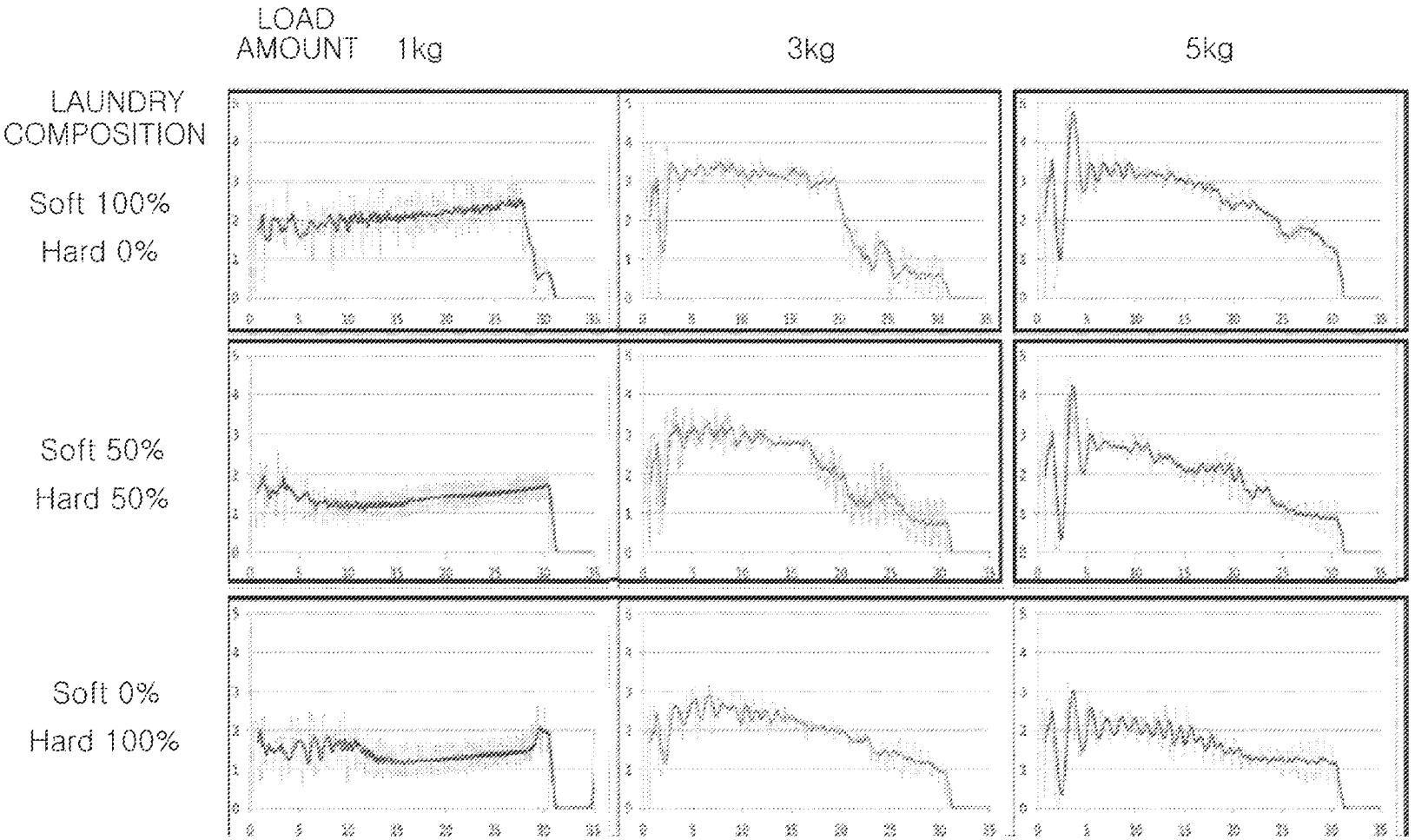
FIG. 3 is a view showing the pattern of current supplied to a motor based on the state of laundry and load weight (laundry weight)
Figure 4:
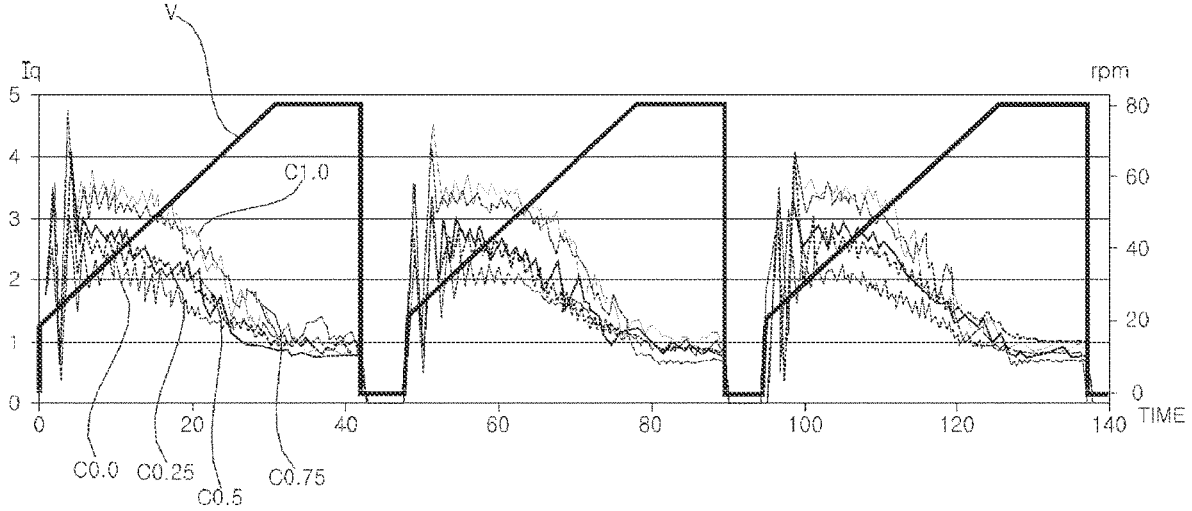
FIG. 4 is a view showing the pattern of current by laundry quality.
Figure 5:
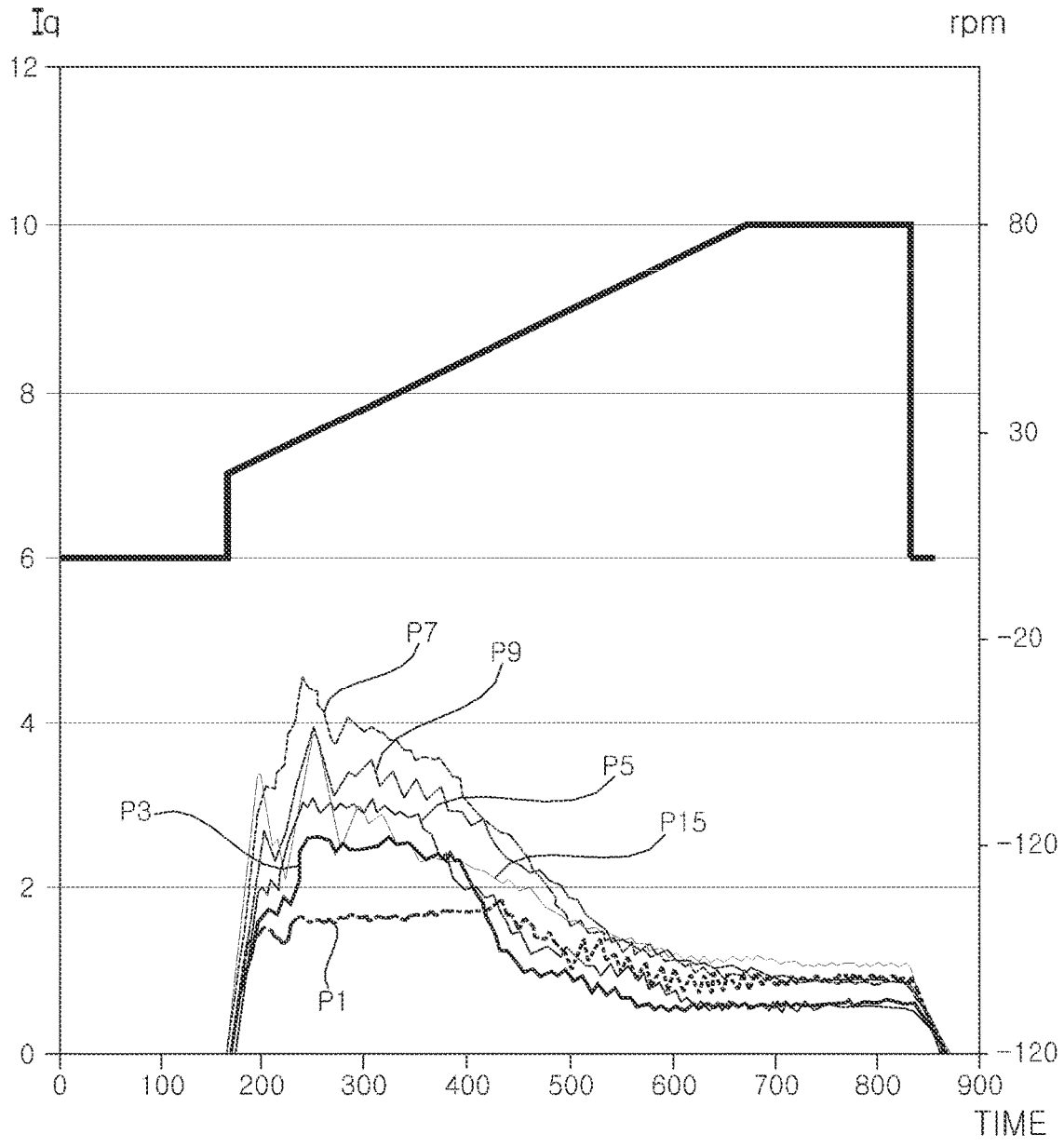
FIG. 5 is a view showing the pattern of current by load in the state in which the speed of a motor is controlled using a predetermined method.

FIG. 3 is a view showing the pattern of current supplied to the motor based on laundry quality and load weight (laundry weight). FIG. 4 is a view showing the pattern of current by laundry quality. FIG. 5 is a view showing the pattern of current by load in the state in which the speed of the motor is controlled using a predetermined method.

Graphs shown in FIG. 3 show present current measured while the washing tub 4 is accelerated to a predetermined target rotational speed (e.g. 80 rpm). In these graphs, measurement was performed while the composition of laundry (i.e. the mixing ratio of soft laundry to hard laundry) and load weight were changed. That is, it is possible to grasp a change in the pattern depending on load weight from the graphs arranged horizontally. For example, in the case of the same composition of laundry, it can be seen that the maximum value of present current in the initial stage of acceleration of the washing tub 4 increases as load weight is increased. Consequently, it may be appropriate to use the initial data of the graphs in order to determine load weight (laundry weight).

It is possible to grasp a change in the pattern depending on the composition of laundry from the graphs arranged vertically. For example, in the case of the same load weight, it can be seen that the current value decreases as the percentage of hard laundry is increased and that this phenomenon is particularly prominent in the intermediate and last stage of acceleration of the washing tub 4, in the intermediate/last stage of rotation of the washing tub 4, or in a period in which the target rotational speed is maintained. Consequently, it may be appropriate to acquire data necessary to acquire laundry quality after a period in which the data to be used to determine laundry weight are acquired.

FIG. 4 shows the pattern of present current by laundry composition (laundry quality). In FIG. 4, C0.0 indicates 100% of soft laundry, C0.25, C0.5, and C0.75 indicate that the ratio of soft laundry to hard laundry is 1:3, 1:1, and 3:1, respectively, and C1.0 indicates 100% of hard laundry. In each case, the total laundry weight (load weight) including both soft laundry and hard laundry is uniform.

The graphs show that, in the case in which laundry composition is changed, the pattern of present current is changed even though load weight is uniform. Consequently, classification according to laundry composition (or laundry weight) is possible based on machine learning of current pattern.

Sensing of laundry weight/laundry quality may be repeated a plurality of times. In this embodiment, sensing of laundry weight/laundry quality is repeated three times. However, the present invention is not limited thereto. Sensing of laundry weight/laundry quality may be repeated a plurality of times at the same step, and may be repeated a plurality of times at different steps.

The controller 60 may set a washing algorithm, or may change the setting of the washing algorithm, according to each result of sensing of laundry weight/laundry quality, and may control the operation of the washing machine according to the set washing algorithm.

Graphs P1, P3, P5, P7, P9, and P15 shown in FIG. 5 indicate that laundry weight is 1, 3, 5, 7, 9, and 15 kg, respectively. Each of the graphs is generally formed such that the present current value is abruptly increased to a predetermined level in the initial stage of acceleration of the washing tub 4 and converges on a uniform value in the last stage of rotation of the washing tub 4. In particular, it can be seen that deviation in the present current value depending on laundry weight is prominent in the initial stage of acceleration of the washing tub 4.

The controller 60 may include a laundry weight/laundry quality learning module 61 and a laundry weight/laundry quality recognition module 62. The laundry weight/laundry quality learning module 61 may perform machine learning using the present current value sensed by the current sensing unit 75 or a value acquired by processing the present current value. The laundry weight/laundry quality learning module 61 may update the database stored in the memory 76 through machine learning.

Any one of unsupervised learning and supervised learning may be used as a learning method of the laundry weight/laundry quality learning module 61.

The laundry weight/laundry quality recognition module 62 may determine a level depending on laundry weight based on data trained by the laundry weight/laundry quality learning module 61. Determination of laundry weight may include classifying laundry introduced into the washing tub 4 into a predetermined plurality of laundry weight levels depending on weight (load).

In this embodiment, laundry weight is classified into five steps (levels). Load weight (kg) corresponding to each step is shown in Table 1 below. In addition, Table 1 statistically shows the number of members constituting a family in the case in which laundry having corresponding laundry weight is introduced into the washing machine for the family.

TABLE 1

| Laundry weight (5 steps) | Load weight | Number of family members |
|---|---|---|
| Level 1 | 0 to 1 kg | 1 |
| Level 2 | 1 to 3 kg | 1 or 2 |
| Level 3 | 3 to 5 kg | 3 |
| Level 4 | 5 to 6 kg | 3 or more |
| Level 5 | 6 kg or more | |

Determination of laundry quality serves to classify laundry introduced into the washing tub 4 based on predetermined criteria. The criteria may include the material of laundry, the softness or hardness of laundry, the water content of laundry, and the volumetric difference between dry laundry and wet laundry.

The laundry weight/laundry quality recognition module 62 may determine one of the laundry weight steps to which laundry introduced into the washing tub 4 corresponds and one of the laundry quality steps to which the laundry corresponds (i.e. laundry quality by laundry weight) based on the present current value acquired from the current sensing unit 75.

In this embodiment, laundry quality is classified into five steps (levels). Kinds of laundry corresponding to each step are shown in Table 2 below. Referring to Table 2, laundry that is soft and is not durable may be determined as level 1 (a first laundry quality step), laundry that is more durable than level 1 laundry may be determined as level 3 (a third laundry quality step), laundry that is more durable than level 3 laundry and is hard may be determined as level 5 (a fifth laundry quality step), a mixture of level 1 laundry and level 3 laundry may be determined as level 2 (a second laundry quality step), and a mixture of level 3 laundry and level 5 laundry may be determined as level 4 (a fourth laundry quality step).

TABLE 2

| Laundry quality (5 steps) | Wear degree/Washing strength | Kind |
|---|---|---|
| Level 1 | Wear degree: high<br>Washing strength: low | Clothes made of light and soft materials and underwear made of delicate materials (e.g. silk) |
| Level 2 | Mixture of level 1 laundry and level 3 laundry | |
| Level 3 | Wear degree: middle<br>Washing strength: middle | Cotton-spun outer garments and cotton-spun/mixed-spun underwear |
| Level 4 | Mixture of level 3 laundry and level 5 laundry | Clothes made of thick materials, coarse materials, and hard materials (e.g. autumn jumpers, winter jumpers, and work clothes) |
| Level 5 | Wear degree: low<br>Washing strength: high | |

The laundry weight/laundry quality recognition module 62 may be equipped with an artificial neural network (ANN) trained in advance based on machine learning. The artificial neural network may be updated by the laundry weight/laundry quality learning module 61.

The laundry weight/laundry quality recognition module 62 may determine laundry weight and laundry quality based on the artificial neural network. In the case in which laundry weight is classified into five steps, as in this embodiment, the laundry weight/laundry quality recognition module 62 may determine the step to which laundry weight belongs, and may also determine the step to which laundry quality belongs, using the present current value sensed by the current sensing unit 75 as input data of the artificial neural network (ANN).

The laundry weight/laundry quality recognition module 62 may include an artificial neural network (ANN) trained to classify laundry weight and laundry quality based on predetermined criteria. For example, the laundry weight/laundry quality recognition module 62 may include a deep neural network (DNN) trained based on deep learning, such as a convolutional neural network (CNN), a recurrent neural network (RNN), and a deep belief network (DBN).

The recurrent neural network (RNN) may have an artificial neural network structure that is frequently used in natural language processing and the like and is effective for processing time-series data which vary over time and that is formed by building up layers at each instance.

The deep belief network (DBN) has a deep learning structure formed by stacking multiple layers of a restricted Boltzmann machine (RBM), which is a deep learning technique. The deep belief network (DBN) may have a predetermined number of layers formed by repeating restricted Boltzmann machine (RBM) learning.

The convolutional neural network (CNN) is a model mimicking a human brain function, built on the assumption that, when a person recognizes an object, the brain extracts basic features of the object and recognizes the object based on the result of complex processing in the brain.

Meanwhile, the artificial neural network may be trained by adjusting connection weights between nodes (if necessary, adjusting bias values as well) so as to produce desired output from given input. The artificial neural network may continuously update the weight values through learning. Methods such as back propagation may be used in training the artificial neural network.

The laundry weight/laundry quality recognition module 62 may determine at least one of laundry weight and laundry quality of laundry introduced into the washing tub 4 from output of an output layer using the present current value as input data and based on weights between nodes included in the deep neural network (DNN).

Figure 7:
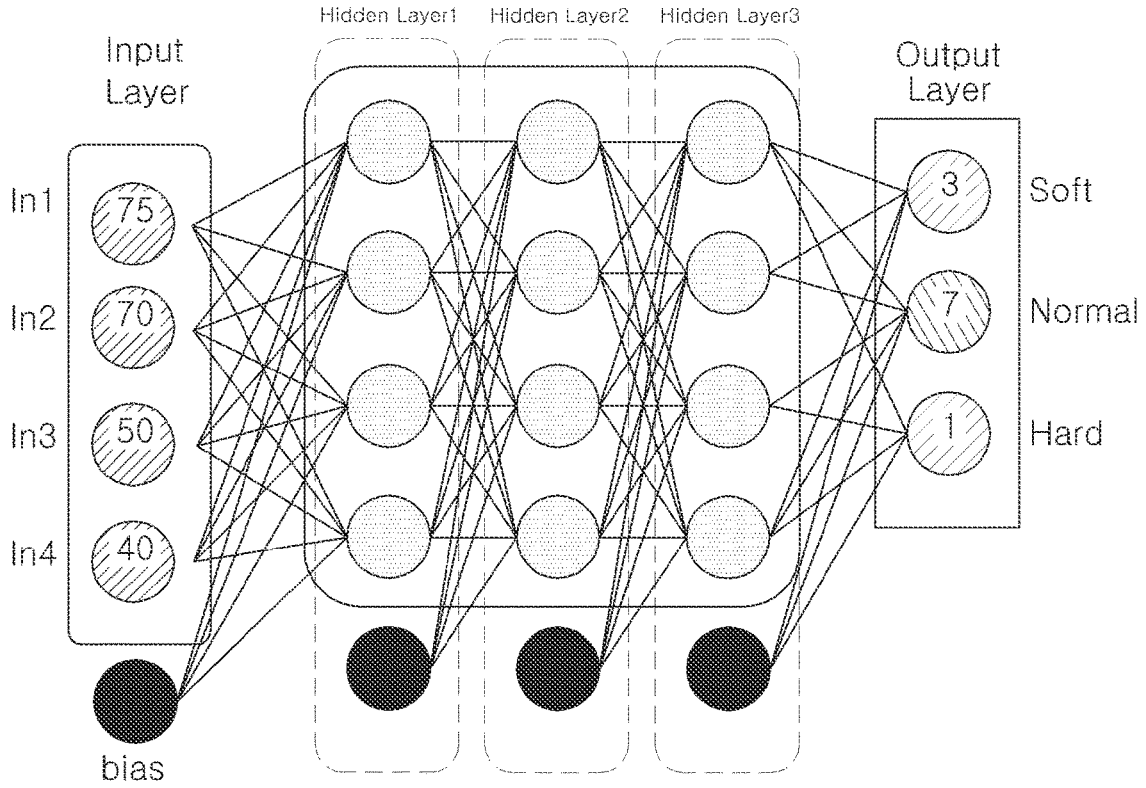
FIG. 7 is a brief view showing an example of the artificial neural network.
Figure 8:
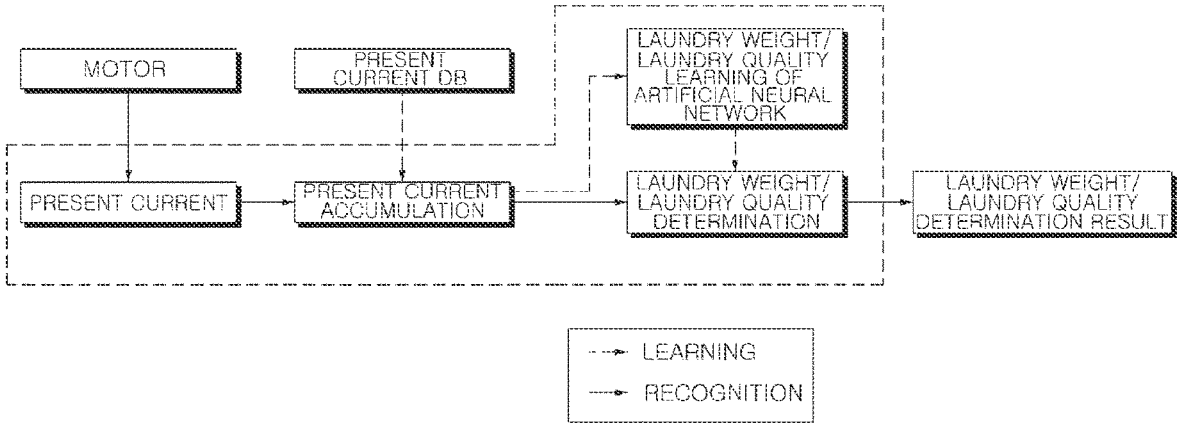
FIG. 8 is a brief view showing a process of determining laundry weight and laundry quality using a present current value of the motor in the state of being divided into a learning process and a recognition process.

FIG. 7 is a brief view showing an example of the artificial neural network. FIG. 8 is a brief view showing a process of determining laundry weight and laundry quality using the present current value of the motor in the state of being divided into a learning process and a recognition process.

Hereinafter, a description will be given with reference to FIGS. 7 and 8. Deep learning, which is a subfield of machine learning, enables data-based learning through multiple layers.

Deep learning may exhibit a collection of machine learning algorithms that extract core data from a plurality of data through a sequence of hidden layers.

The deep learning structure may include an artificial neural network (ANN). For example, the deep learning structure may include a deep neural network (DNN), such as a convolutional neural network (CNN), a recurrent neural network (RNN), and a deep belief network (DBN).

Referring to FIG. 7, the artificial neural network (ANN) may include an input layer, hidden layers, and an output layer. The deep neural network (DNN) includes a plurality of hidden layers. Each layer includes a plurality of nodes, and each layer is related to the next layer. The nodes may be connected to each other while having weights.

Output from an arbitrary node belonging to a first hidden layer (hidden Layer 1) becomes input to at least one node belonging to a second hidden layer (hidden Layer 2). At this time, input to each node may be a value obtained by applying a weight to output from a node of the previous layer. A weight may mean connection strength between nodes. The deep learning process may be a process of discovering an appropriate weight.

A well-known facial recognition process will be described for better understanding of deep learning. A computer may distinguish between bright pixels and dark pixels depending on the brightness of pixels, may distinguish between simple forms, such as contours and edges, and may distinguish between complicated forms and objects from an input image. Finally, the computer may grasp a form prescribing the face of a human. Materialization of such a feature (prescription of the facial form of the human) is finally obtained from the output layer through a plurality of hidden layers.

The memory 76 may store input data for sensing laundry weight and data necessary to train the deep neural network (DNN). The memory 76 may store motor speed data acquired by the speed sensing unit 74 and/or speed data in the state of being added or processed by predetermined period. In addition, the memory 76 may store weights and biases constituting a deep neural network (DNN) structure.

Alternatively, in some embodiments, the weights and biases constituting the deep neural network structure may be stored in a memory embedded in the laundry weight/laundry quality recognition module 62.

Meanwhile, the laundry weight/laundry quality learning module 61 may perform learning using the present current value sensed by the current sensing unit 75 as training data. That is, whenever recognizing or determining laundry weight and/or laundry quality, the laundry weight/laundry quality learning module 61 may add the result of determination to the database in order to update the deep neural network (DNN) structure, such as weights or biases. Alternatively, after training data are secured a predetermined number of times, the learning process may be performed using the secured training data in order to update the deep neural network (DNN) structure, such as weights.

The washing machine according to the embodiment of the present invention may transmit data about the present current acquired by the current sensing unit 75 to a server (not shown) connected to a communication network through the communication unit 73, and may receive data related to machine learning from the server. In this case, the washing machine may update the artificial neural network based on the data related to machine learning received from the server.

Figure 9A:
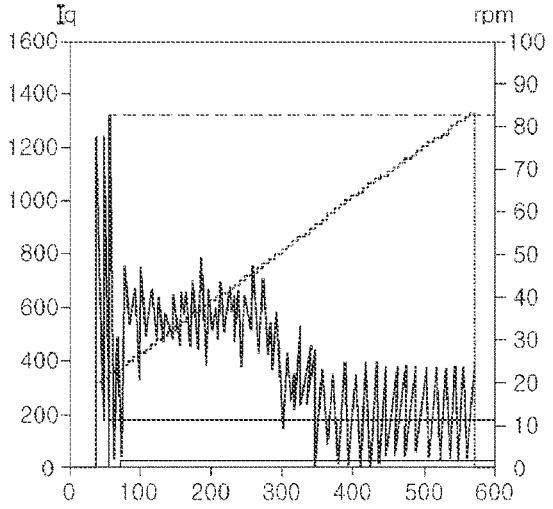
FIG. 9A is a graph showing a present current value sensed by the current sensing unit and FIG. 9B is a graph showing average values acquired by processing a moving average filter.
Figure 9B:
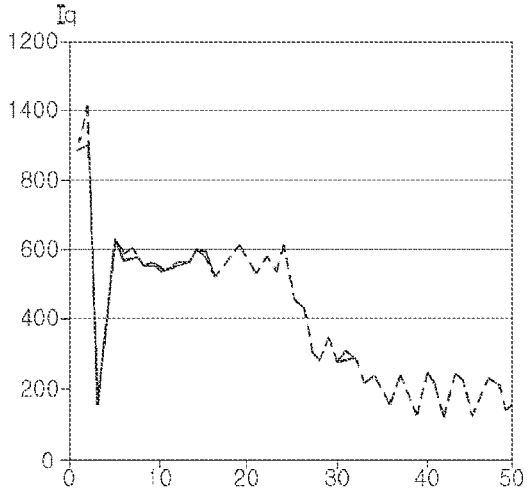
Figure 10:
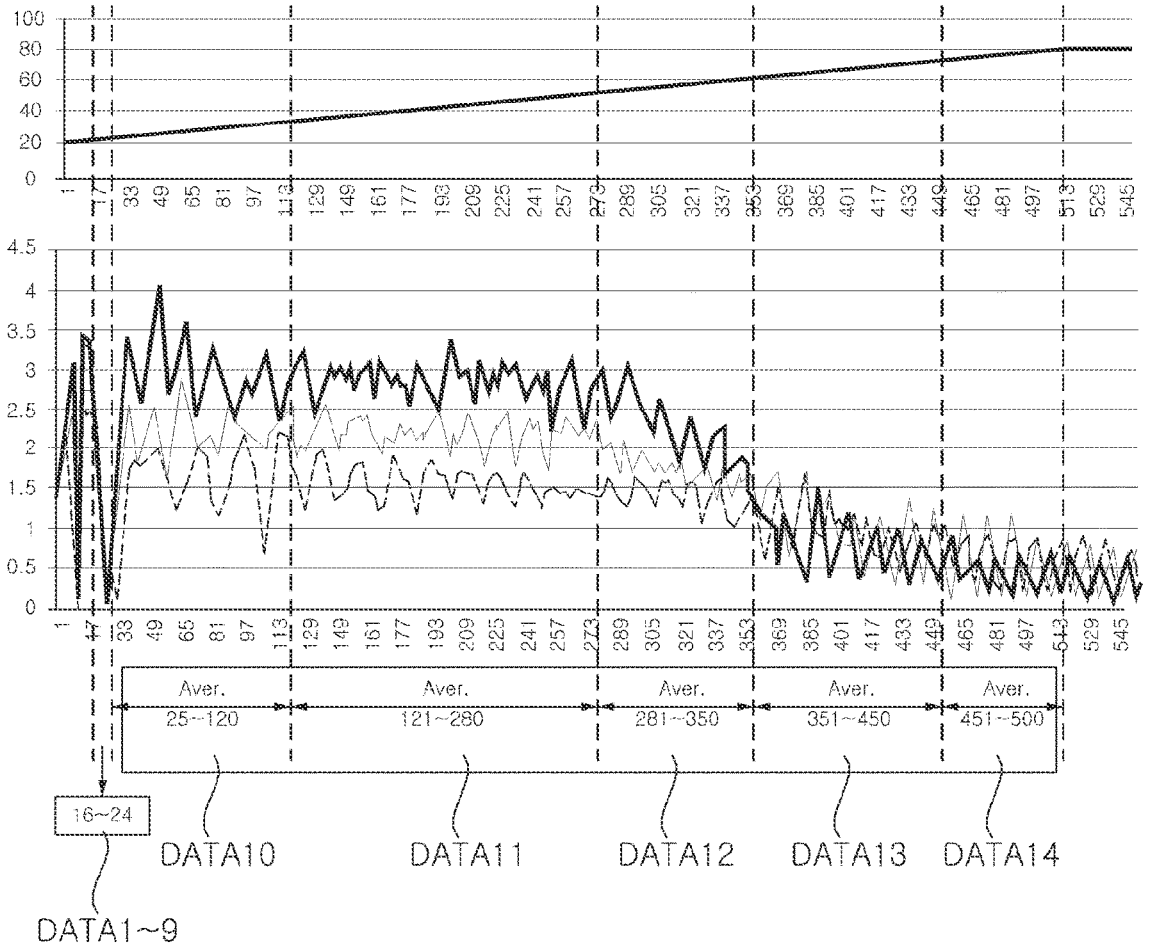
FIG. 10 is a graph showing current values sensed by the current sensing unit.
Figure 11:
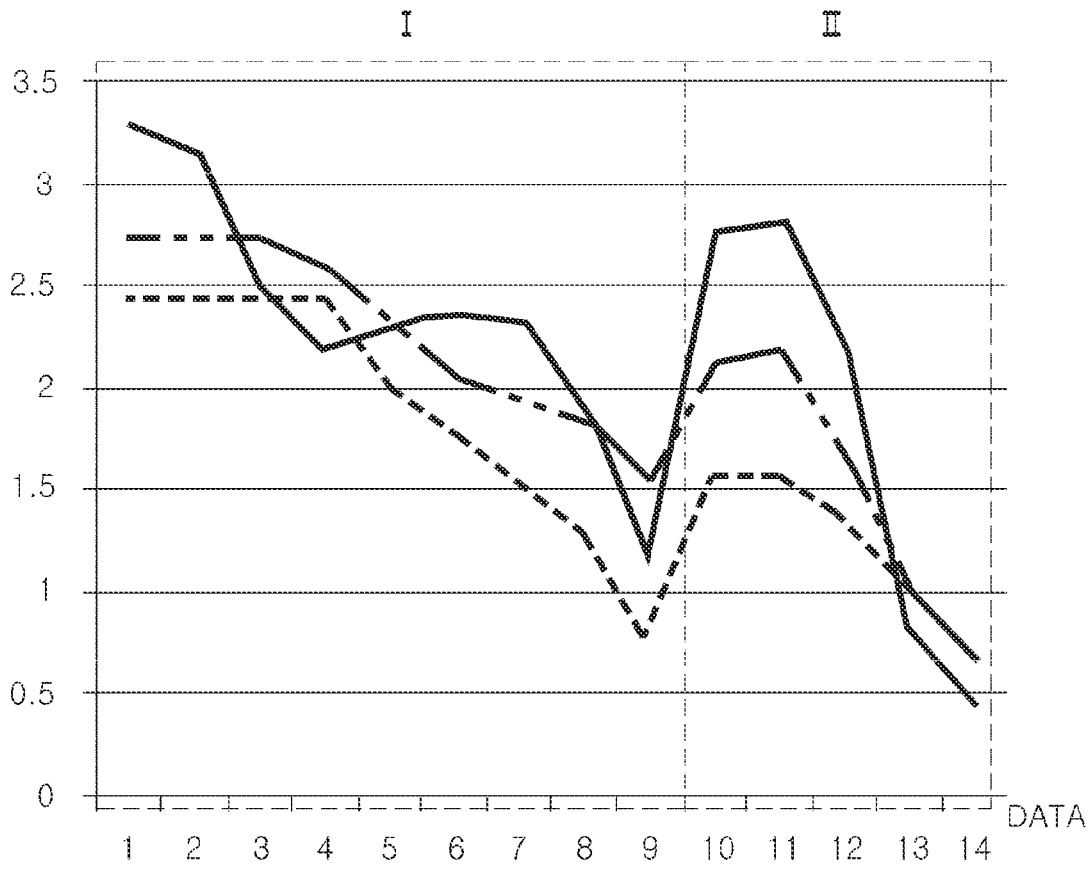
FIG. 11 is a graph showing values acquired by processing the current values of the graph shown in FIGS. 9A to 9B so as to be used as input data of the artificial neural network.
Figure 12:
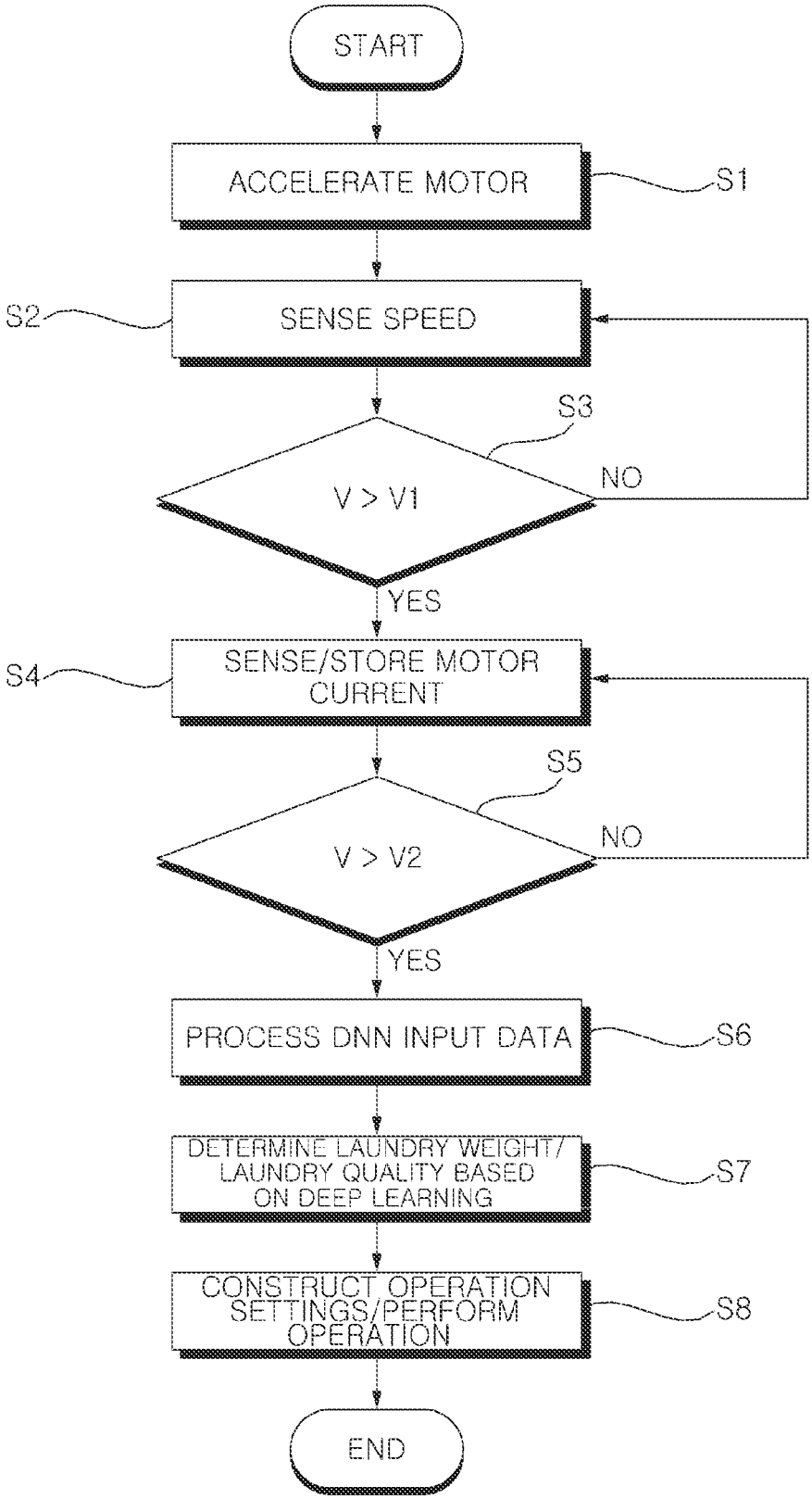
FIG. 12 is a flowchart showing a method of controlling a washing machine according to an embodiment of the present invention.

FIG. 9A is a graph showing the present current value sensed by the current sensing unit and FIG. 9B is a graph showing average values obtained by processing a moving average filter. FIG. 10 is a graph showing current values sensed by the current sensing unit. FIG. 11 is a graph showing values obtained by processing the current values of the graph shown in FIGS. 9A and 9B so as to be used as input data of the artificial neural network. FIG. 12 is a flowchart showing a method of controlling the washing machine according to the embodiment of the present invention. Hereinafter, a method of determining laundry weight and laundry quality will be described with reference to FIGS. 9A to 12.

The controller 60 performs control such that the motor 9 is rotated at a predetermined target rotational speed (S1, S2, S3, S4, and S5). During rotation of the motor 9, the rotational speed of the washing tub 4 (or the motor 9) is sensed by the speed sensing unit 74 (S2).

The target rotational speed may be set as a rotational speed of the washing tub 4 at which the state in which laundry clings to the drum 42 can be maintained when the washing tub 4 is continuously rotated one or more revolutions in one direction while maintaining the target rotational speed. That is, the target rotational speed may be set as the rotational speed of the washing tub 4 at which the laundry can be rotated integrally with the drum 42. When the washing tub 4 is rotated at the target rotational speed, centrifugal force applied to the laundry due to the rotation of the washing tub 4 may be greater than gravity applied to the laundry.

The target rotational speed may be 60 to 80 rpm, preferably 80 rpm. Preferably, in the state before the rotational speed of the washing tub 4 reaches the target rotational speed, the laundry moves in the drum 42. That is, the laundry is raised to a predetermined height and then dropped by rotation of the drum 42.

Meanwhile, the target rotational speed may be set based on the state in which water is supplied into the water storage tub 3 and thus a portion of the washing tub 4 is immersed in the water. That is, the laundry may move when the washing tub 4 is rotated at the target rotational speed in the state in which a portion of the washing tub 4 is immersed in the water. In other words, during rotation of the washing tub 4, the laundry does not constantly cling to the drum 42 but may be raised to a predetermined height and then dropped.

The present current values used to determine laundry weight and laundry quality include values adopted in a period in which the laundry moves during rotation of the washing tub 4. That is, the controller 60 may adopt the present current values that are necessary based on the rotational speed of the washing tub 4 (or the rotational speed of the motor 9) sensed by the speed sensing unit 74.

Specifically, the controller 60 commands the motor driving unit 71 to accelerate the motor 9, and, when the rotational speed sensed by the speed sensing unit 74 reaches a predetermined first rotational speed V1, may store the present current value from that time in the memory 76 (S3 and S4).

In the initial stage of an acceleration period of the motor 9, various factors, such as the position of the laundry in the washing tub 4, may be excessively reflected in the current value applied to the motor 9, in addition to laundry weight and laundry quality.

Preferably, therefore, the initial current value in the acceleration period is excluded as input data for determining laundry weight and laundry quality. That is, the current value until the rotational speed V of the motor 9 reaches the first rotational speed V1 may not be used as input data, and the current value sensed after the rotational speed V of the motor 9 reaches the first rotational speed V1 may be used as input data.

The first rotational speed V1 may be lower than a second rotational speed V2, and may be a rotational speed at which the laundry moves in the washing tub 4. The first rotational speed V1 may be 10 to 20 rpm.

When the rotational speed V of the washing tub 4 reaches the predetermined second rotational speed V2, the controller 60 may not store the present current value any longer, and may process the present current value (S5 and S6). Here, the second rotational speed V2 is the target rotational speed.

Meanwhile, the acceleration gradient in the acceleration period from the first rotational speed V1 to the second rotational speed V2 may be uniform. Preferably, the acceleration gradient is maintained uniform in order to improve reliability in sensing a change in the pattern of current.

The acceleration gradient must not be too high such that a change in the movement of laundry in the washing tub 4 is clearly exhibited. The acceleration gradient is preferably 1.5 to 2.5 rpm/s, more preferably 2.0 rpm/s. However, the present invention is not limited thereto. The acceleration gradient may have a smallest possible value within a range controllable by the controller 60.

Figure 6:
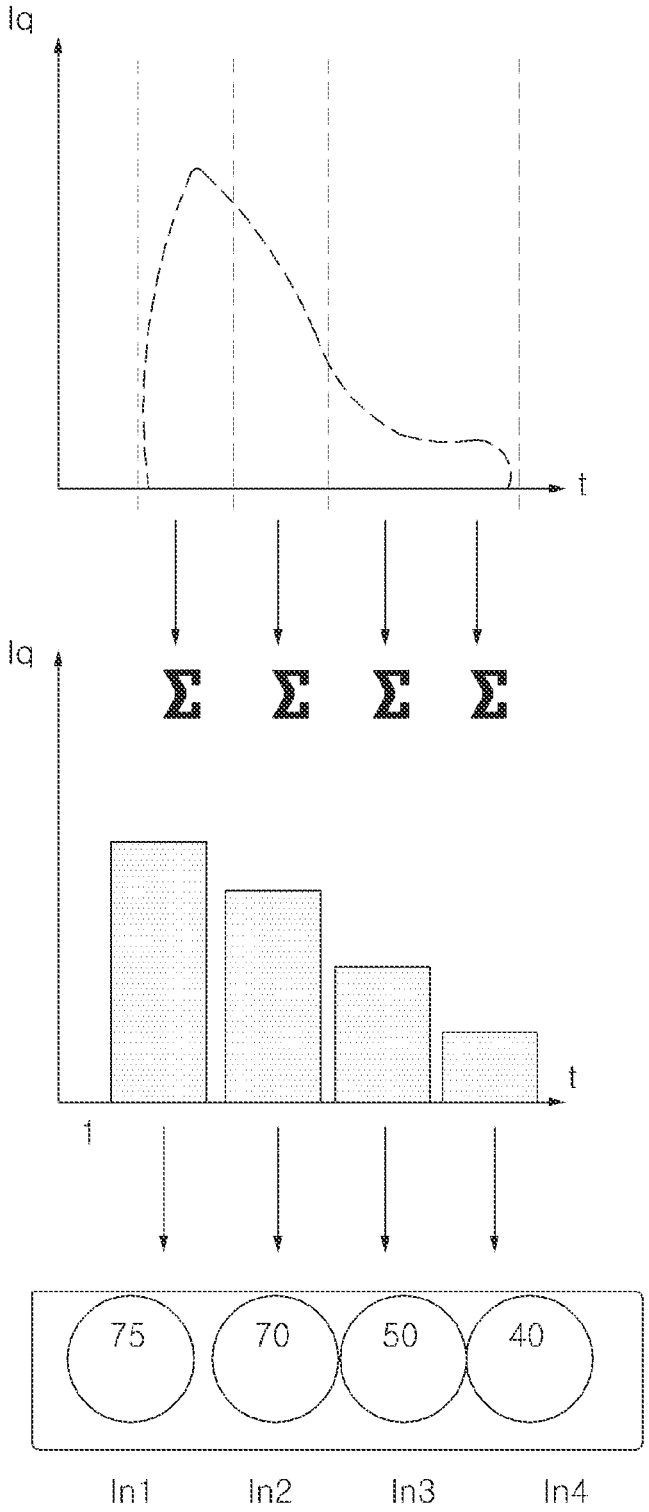
FIG. 6 is a view showing a process of processing present current values acquired by a current sensing unit as input data of an artificial neural network.

As shown in FIG. 6, processing of the present current value is a process of processing the present current values Iq obtained at predetermined points of time according to a predetermined algorithm in order to generate input data In1, In2, In3, In4 . . . of the input layer of the artificial neural network (S6).

This process may include a step of obtaining the average of the present current values Iq and a step of processing the obtained average values according to a predetermined parsing rule in order to generate input data of the artificial neural network. In particular, the number of input data processed according to the parsing rule is less than the number of average values.

Referring to FIG. 8, the controller 60 may acquire current values at predetermined time intervals through the current sensing unit 75. In this embodiment, a total of 545 present current values are obtained at predetermined time intervals in a period in which the rotational speed of the washing tub 4 is accelerated from the first rotational speed V1 to the second rotational speed V2.

The controller 60 may average the present current values thus obtained in every predetermined time period. At this time, the controller 60 may use a moving average filter. Moving average is obtaining an average while changing a period such that a change can be seen. For example, on the assumption that the present current values are Iq1, Iq2, Iq3 . . . Iqn in a time-series sequence, Iq1 to Iql (l<n) are averaged to obtain M1, and Iqm (m>1) to Iqm+s−1 (s being the number of Iq used to obtain each moving average) are averaged to obtain M2. In this way, moving averages may be obtained while continuously changing a period.

In the case in which time periods in which the moving average is obtained are appropriately set, the number of moving average values M1, M2 . . . may be less than the number of total present current values Iq. As the length of a time period (window) is increased, however, the resolution of a change in the present current is lowered. Therefore, it is necessary to appropriately select the length of the time period. In this embodiment, the controller 60 obtains 50 moving averages from 545 present current values Iq using the moving average filter.

The controller 60 may process the present current values and the moving averages according to the predetermined parsing rule in order to generate input data In1, In2, In3, In4 . . . . The parsing rule may be configured to select a period in which final input data are obtained such that features (laundry weight/laundry quality) to be obtained are well exhibited.

Referring to FIG. 10, in the embodiment of the present invention, a total of 14 input data are generated, and the input data include 9 present current values DATA1 to DATA9 obtained at the initial stage of acceleration of the motor 9 ($16^{th}$ to $24^{th}$ present current values) and five average values DATA10 to DATA14 in subsequent periods divided according to a predetermined condition. In particular, the five average values are obtained based on the previously obtained moving averages, whereby it is possible to process the operation more rapidly than adding the present current values in respective periods. Meanwhile, input data In1, In2, In3, In4 . . . In14 thus obtained become the input values of respective nodes of the input layer.

Weights and biases assigned to nodes constituting the artificial neural network are set through machine learning. Such machine learning is repeated based on a current pattern or present current values. In addition, since the characteristics about laundry weight and/or laundry quality are reflected in the current pattern (or the present current value) as described above, machine learning may be performed on data that are previously stored or added by operation of the washing machine until an accurate result (i.e. accurate laundry weight and laundry quality of laundry introduced into the washing tub 4) is derived, whereby it is possible to set improved or accurate weights and biases.

In the artificial intelligence network constructed as described above, laundry weight-laundry quality information may be reflected in the output of the output layer, and the controller 60 may determine laundry weight and/or laundry quality based on a node that outputs the largest value, among the nodes of the output layer.

The controller 60 may input the input data generated at step S6 into the artificial neural network in order to obtain laundry weight and/or laundry quality from the output of the output layer (S7). Subsequently, the controller 60 may set a washing algorithm based on the laundry weight and/or laundry quality obtained at step S7, and may control the operation of the washing machine according to the set washing algorithm (S8). The washing algorithm may include a water supply level, washing time, rising time, spin-drying time, and drying time, and a motor driving pattern in each cycle (e.g. a rotational speed, rotation time, acceleration, and braking).

Figure 13:
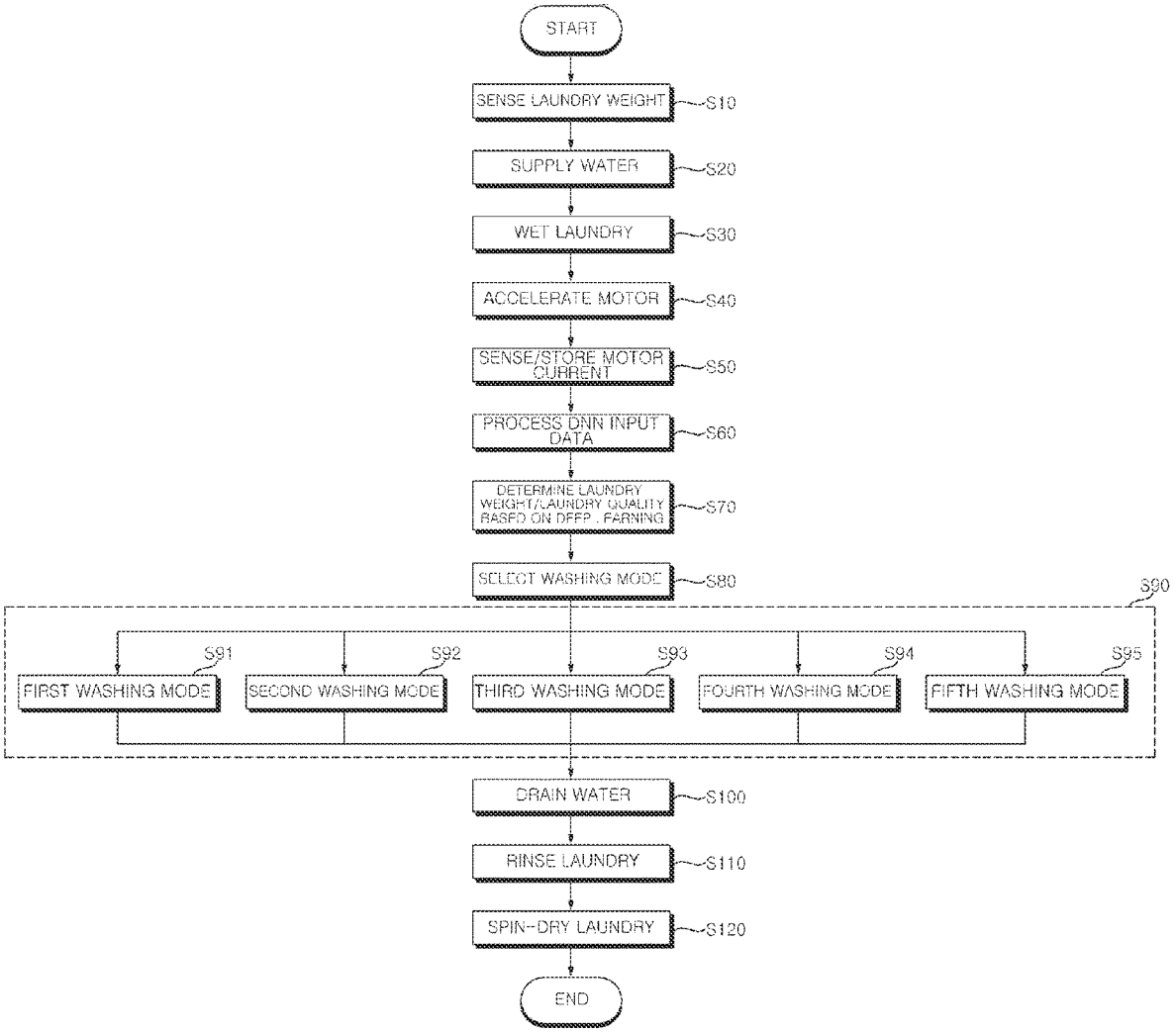
FIG. 13 is a flowchart showing a method of controlling a washing machine according to a first embodiment of the present invention.
Figure 14:
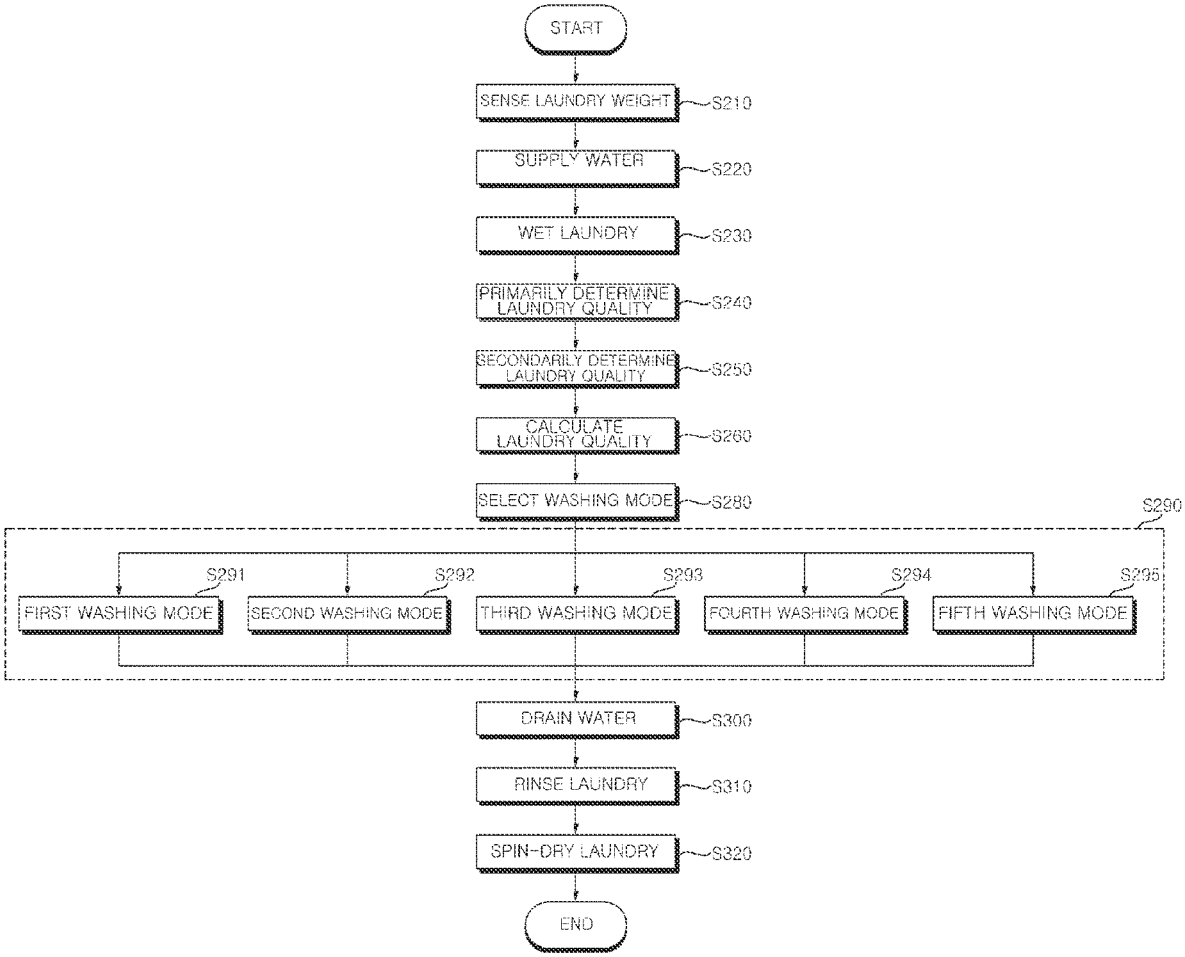
FIG. 14 is a flowchart showing a method of controlling a washing machine according to a second embodiment of the present invention.
Figure 15A:
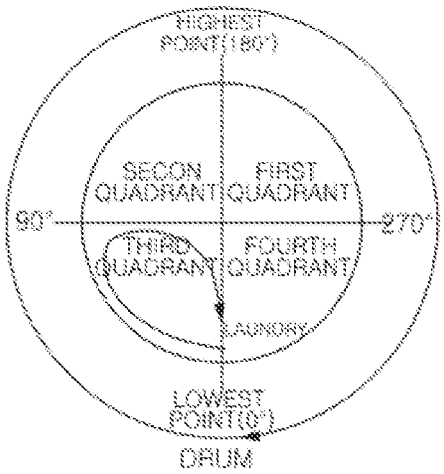
FIGS. 15A to 15C are schematic views showing a washing motion that can be performed during a washing cycle.
Figure 15B:
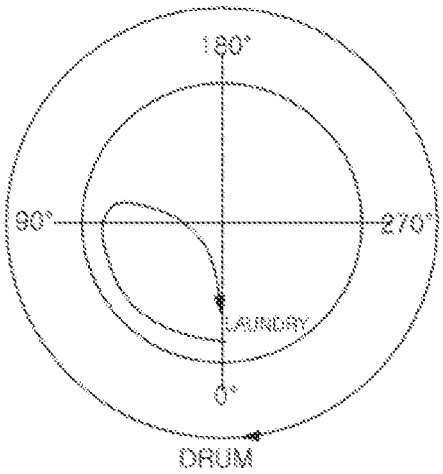
Figure 15C:
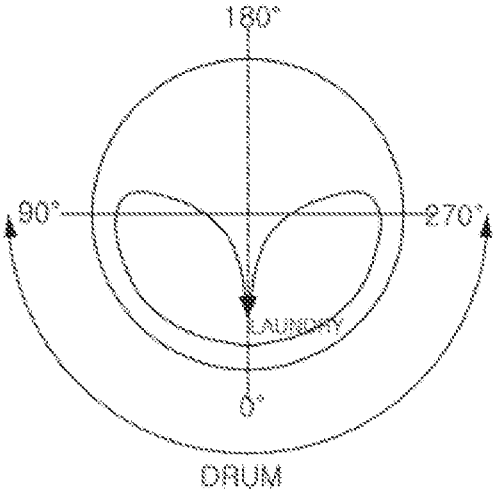

FIG. 13 is a flowchart showing a method of controlling a washing machine according to a first embodiment of the present invention. FIG. 14 is a flowchart showing a method of controlling a washing machine according to a second embodiment of the present invention. FIGS. 15A to 15C are schematic views showing a washing motion that can be performed during a washing cycle of the washing machine according to the embodiment of the present invention.

The method of controlling the washing machine according to the embodiment of the present invention includes a step of obtaining the state of laundry using an artificial neural network. The state of laundry may be defined based on the material of laundry and the composition of laundry (i.e. the mixing ratio of soft laundry to hard laundry).

The material of laundry may be defined as including several characteristics of laundry, such as the hardness of laundry (e.g. soft laundry/hard laundry), the ability of laundry to contain water (i.e. water content), and the volumetric difference between dry laundry and wet laundry.

In addition, the characteristics of laundry are related to each other. Laundry, such as blue jeans and coats, may be relatively hard, may have low water content, and may have a small volumetric difference between dry laundry and wet laundry. In contrast, laundry made of silk and cotton may be relatively soft, may have high water content, and may have a large volumetric difference between dry laundry and wet laundry. That is, harder laundry may have lower water content, and may have a smaller volumetric difference between dry laundry and wet laundry.

In addition, harder laundry may be less damaged by washing, and softer laundry may be more damaged by washing.

Also, in many cases, harder laundry is generally washed after being worn a plurality of times, whereby the contamination level of the laundry may be higher. For example, in many cases, blue jeans and coats are washed after being worn a plurality of times, and underwear made of silk or cotton is washed after being worn once.

Consequently, it is necessary to construct a washing algorithm in the state in which the state of laundry is reflected. More specifically, relatively soft laundry is washed according to a washing mode in which low damage to laundry is more important than washing performance, and relatively hard laundry is washed according to a washing mode in which washing performance is more important than low damage to laundry, whereby it is possible to prevent the damage to laundry and to improve washing performance.

Hereinafter, the method of controlling the washing machine according to the first embodiment of the present invention will be described with reference to FIGS. 12, 13, and 15A to 15C.

When the washing machine is powered on, the washing machine is on standby in the state of being capable of receiving a washing course, and may receive a washing course from a user through an input unit (not shown). In the standby state, the washing machine may receive a washing option from the user through the input unit.

After receiving the washing course and the washing option, the washing machine obtains the weight of laundry received in the washing tub (S10; a laundry weight sensing step). At the laundry weight sensing step (S10), the weight of laundry may be obtained using a conventional method of sensing the weight of dry laundry.

After the weight of the laundry is obtained and before the state of the laundry is obtained using the artificial neural network, the controller 60 may control the water supply valve 5 such that wash water is supplied into the washing tub 4 (S20; a water supply step). The amount of wash water that is supplied into the washing tub may be set based on the weight of laundry obtained at the laundry weight sensing step (S10). That is, as the weight of laundry is increased, a larger amount of wash water may be supplied.

Meanwhile, the step of supplying the wash water into the washing tub 4 may be performed after a step of selecting a washing mode based on the state of the laundry, a description of which will follow, and at the initial stage of a washing cycle step at which washing is performed according to the selected washing mode.

Alternatively, after the laundry weight sensing step (S10), wash water may be supplied based on the weight of laundry (a first water supply step), and, after a step of determining the state of laundry, a description of which will follow, wash water may be supplied in consideration of both the weight of laundry and the state of laundry at the initial stage of the washing cycle step (a second water supply step). At this time, in the case in which the amount of wash water to be supplied at the second water supply step is larger than the amount of wash water that is supplied in consideration of the weight of laundry and the state of laundry, an excessive amount of wash water may be drained. In the case in which the amount of wash water to be supplied at the second water supply step is smaller than the amount of wash water that is supplied in consideration of the weight of laundry and the state of laundry, wash water may be replenished.

Alternatively, after all of the wash water supplied at the first water supply step is drained, wash water may be supplied in consideration of the weight of laundry and the state of laundry at the second water supply step. In this case, detergent received in the dispenser 7 may not be introduced into the washing tub at the first water supply step, but the detergent received in the dispenser 7 may be introduced into the washing tub at the second water supply step.

For example, the dispenser 7 may include two dispensers, or a single dispenser may be partitioned into two spaces. One dispenser (or one space in the dispenser) may be a dispenser for receiving preliminary washing detergent, and the other dispenser (or the other space in the dispenser) may be a dispenser for receiving main washing detergent.

At the first water supply step, wash water may be supplied to the washing tub 4 via the dispenser for receiving preliminary washing detergent, and at the second water supply step, wash water may be supplied to the washing tub 4 via the dispenser for receiving main washing detergent.

In the case in which water is supplied before the step of obtaining the state of laundry, when laundry having the same composition is introduced, a consistent current pattern may be derived, whereby it is possible to more accurately determine the state of laundry.

After the wash water is supplied, a laundry wetting step (S30), at which the laundry is wetted, is performed. The laundry wetting step (S30) is performed in order to improve accuracy in determining laundry quality/laundry weight using the artificial neural network. At the initial stage of supplying wash water into the washing tub 4, some of the laundry received in the washing tub 4 may excessively contain water, and some of the laundry may not be wetted. The current value Iq supplied to the motor 9 while accelerating the washing tub 4 in this state may be sensed as different values depending on measurement time even under conditions of same laundry weight/laundry quality.

At the laundry wetting step (S30), therefore, the washing tub 4 may be on standby for a predetermined time in the state in which wash water is supplied into the washing tub 4, or the washing tub 4 may be rotated in order to uniformly wet the laundry. Also, in the case in which the washing machine includes a circulation pump (not shown) and a circulation nozzle (not shown) for circulating the water stored in the water storage tub 3, the wash water may be circulated in order to efficiently wet the laundry.

The method of controlling the washing machine according to the first embodiment of the present invention includes a first sensing step (S40 to S70) of obtaining the state of laundry using the artificial neural network. At the first sensing step (S40 to S70), the state of laundry is determined from output of an output layer (see FIG. 7) of an artificial neural network pre-trained based on machine learning using a current value Iq supplied to the motor 9 for rotating the washing tub 4 during accelerated rotation of the washing tub 4 as input data of an input layer (see FIG. 7) of the artificial neural network.

At the first sensing step (S40 to S70), the state and weight of laundry received in the washing tub 4 may be obtained from output of the output layer of the artificial neural network using the current value Iq as input data of the input layer of the artificial neural network After the laundry wetting step (S30), the weight and state of laundry may be obtained through steps S40 to S70, which are identical to steps S1 to S7 described with reference to FIG. 12. That is, S40 includes S1, S2, and S3, S50 includes S4 and S5, S60 is identical to S6, and S70 is identical to S7.

The first sensing step (S40 to S70) includes a step of accelerating the washing tub 4 (or the motor 9) (S40; a first acceleration step), a step of obtaining a current value Iq (a first current value) that is supplied to the motor 9 in a period in which the washing tub 4 is rotated while being accelerated (a first acceleration period), and a step of determining the weight and state of laundry from output of the output layer of the artificial neural network (S70) using the current value Iq as input data of the input layer of the artificial neural network (S60).

The step of accelerating the washing tub 4 (S40) includes a step of sensing the rotational speed V of the motor 9 (or the washing tub 4). The step of accelerating the washing tub 4 (S40) includes a step of rotating the washing tub 4 while accelerating the washing tub 5 from a first rotational speed V1 to a second rotational speed V2, which is higher than the first rotational speed V1. The step of accelerating the washing tub 4 (S40) includes a step of accelerating the rotational speed V of the washing tub 4 at a uniform acceleration from the first rotational speed V1 to the second rotational speed V2. That is, the controller 60 may accelerate the motor 9 at a uniform acceleration when accelerating the motor 9 from the first rotational speed V1 to the second rotational speed V2.

The step of determining the weight and state of laundry (S60 and S70) includes a step of using the current value Iq supplied to the motor 9 in a period in which the rotational speed V of the washing tub 4 is accelerated from the first rotational speed V1 to the second rotational speed V2 as input data of the input layer of the artificial neural network. More specifically, the step of determining the weight and state of laundry (S60 and S70) may include a step of selecting a current value corresponding to a period in which the rotational speed V of the washing tub 4 is accelerated from the first rotational speed V1 to the second rotational speed V2 from among current values obtained at step S70 based on the sensed speed value and a step of using the selected current value as input data of the input layer of the artificial neural network.

The method of controlling the washing machine according to the first embodiment of the present invention may include a step (S80) of selecting any one washing mode from among a plurality of washing modes based on the state of laundry obtained at the first sensing step after the first sensing step (S40 to S70). At the washing mode selection step (S80), any one washing mode may be selected based on the state and weight of laundry. The weight of laundry may be laundry weight obtained at the laundry weight sensing step (S10). Alternatively, the weight of laundry may be laundry weight obtained at the first sensing step (S40 to S70).

The state of laundry may be classified in consideration of the hardness of laundry. At the first sensing step, the state of laundry may be determined to be one of the laundry quality steps (see Table 2) classified in consideration of the hardness of laundry.

A plurality of washing modes (S91 to S95) may be classified in consideration of the wear degree of laundry (hereinafter, also referred to as damage to laundry) and/or washing strength. In this embodiment, the washing modes may include first to fifth washing modes (S91 to S95).

The controller may select a washing mode in which washing performance is important for hard laundry, and may select a washing mode in which damage to laundry is low for soft laundry.

Factors that affect washing performance and the wear degree of laundry (hereinafter referred to as "washing affecting factors") may include the washing motion of the washing tub (or the rotational speed of the washing tub), the amount of water that is supplied, the temperature of water that is supplied, washing cycle time, the net acting ratio of washing, and the net acting ratio of circulation. Hereinafter, washing affecting factors at the time of the washing cycle based on the washing mode will be described.

At the time of the washing cycle, the rotational speed of the washing tub 4 may be within a range of 30 rpm to 60 rpm. If the rotational speed of the washing tub 4 is too low, the movement of laundry due to the rotation of the washing tub 4 is small, whereby it is not possible to obtain satisfactory washing performance. As the rotational speed of the washing tub 4 is increased, the laundry clings to the inner surface of the drum 42 due to centrifugal force, whereby the laundry may be dropped from a higher position. At a rotational speed at which centrifugal force is greater than gravity, the laundry clings to the inner surface of the drum 42, whereby the laundry is not dropped, which is a filtration motion.

At the time of the washing cycle, the washing tub 4 may be rotated at a rotational speed of at least 30 rpm in order to move laundry and thus to obtain satisfactory washing performance.

In addition, the filtration motion is a motion suitable for a spin-drying cycle. At the time of the washing cycle, it is difficult to sufficiently transmit mechanical force due to friction, bending and stretching, and dropping to the laundry. At the time of the washing cycle, therefore, the washing tub must be rotated at a rotational speed that is lower than a rotational speed at which filtration is realized. In general, centrifugal force may be greater than gravity at a rotational speed of 60 rpm or higher. At the time of the washing cycle, therefore, the rotational speed of the washing tub 4 may be lower than 60 rpm.

The controller 60 may control the rotational speed of the washing tub 4 through the motor 9 according to the washing mode determined depending on laundry quality and/or laundry weight. The controller 60 may control the rotational speed of the washing tub according to the washing mode such that a washing mode in which washing performance is important is executed for hard laundry and such that a washing mode in which damage to laundry is low is executed for soft laundry.

The washing motion performed at the time of the washing cycle according to the washing mode will be described with reference to FIGS. 15A to 15C. FIG. 15A shows a rolling motion, FIG. 15B shows a tumbling motion, and FIG. 15C shows a swing motion.

The controller 60 may control the rotational speed and rotation direction of the motor 9 (or the washing tub 4). As a result, the controller 60 may realize various washing motions at the time of the washing cycle.

The rolling motion is a motion in which the washing tub 4 is rotated in one direction such that laundry placed on the inner surface of the drum 42 is dropped to the lowest point of the drum 42 from a position at which the laundry is located below approximately 90 degrees in the rotational direction of the washing tub 4.

The rolling motion is a washing motion in which, when the washing tub 4 is rotated in one direction, for example, in the clockwise direction, the laundry continuously rolls in the third quadrant of the drum 42.

The tumbling motion is a motion in which the washing tub 4 is rotated in one direction such that laundry placed on the inner surface of the drum 42 is dropped to the lowest point of the drum 42 from a position at which the laundry is located between approximately 90 degrees and 110 degrees in the rotational direction of the washing tub 4.

The tumbling motion is a washing motion in which, when the washing tub 4 is rotated in one direction, for example, in the clockwise direction, the laundry is raised from the third quadrant to the second quadrant of the drum 42 and is then dropped to the lowest point of the drum 42 while being separated from the inner surface of the drum 42, which is continuously repeated.

The rotational speed of the washing tub 4 in the tumbling motion is higher than the rotational speed of the washing tub 4 in the rolling motion. Consequently, centrifugal force applied to the laundry is increased, whereby the laundry is dropped from a higher position.

The swing motion is a motion in which the washing tub 4 is rotated in alternating directions (i.e. is alternately rotated in one direction and in the opposite direction) such that laundry placed on the inner surface of the drum 42 is dropped from a position at which the laundry is located below approximately 90 degrees in the rotational direction of the washing tub 4.

More specifically, the washing tub 4 is rotated in the counterclockwise direction and is stopped before the laundry reaches approximately 90 degrees in the counterclockwise direction of the drum 42, and the laundry is dropped to the lowest point of the drum 42 from a position at which the laundry is located below approximately 90 degrees in the counterclockwise direction of the drum 42. Subsequently, the washing tub 4 is rotated in the clockwise direction and is stopped before the laundry reaches approximately 90 degrees in the clockwise direction of the drum 42, and the laundry is dropped to the lowest point of the drum 42 from a position at which the laundry is located below approximately 90 degrees in the clockwise direction of the drum 42. The washing tub 4 is alternately rotated in the counterclockwise direction and in the clockwise direction In the swing motion, the washing tub 4 is rotated in alternating directions, whereby the direction in which force is applied to the laundry is continuously changed, and movement time of the laundry is shorter than in other motions. Consequently, damage to the laundry is less than in other washing motions.

The tumbling motion is a motion that is generally used for a washing cycle of a front load type washing machine, and washing performance is higher and possible damage to the laundry is greater than in the swing motion.

Meanwhile, in the case in which the drum 42 is rotated within a predetermined rotational speed period (e.g. 30 rpm to 60 rpm), the laundry moves in the washing tub 4, whereby the laundry is washed. Force applied to the laundry in order to wash the laundry mainly includes bending and stretching force, by which the laundry is bent and stretched during movement thereof, frictional force generated between laundry articles or between the laundry and the inner surface of the drum 42, and impact force, which is applied to the laundry when the laundry is raised and is then dropped.

In the rolling motion, the frictional force and the bending and stretching force are higher than the impact force. In the tumbling motion, the impact force is higher than the frictional force and the bending and stretching force. In general, washing performance by the frictional force and the bending and stretching force is higher than washing performance by the impact force.

Consequently, washing performance in the rolling motion is higher than washing performance in the tumbling motion. In the tumbling motion, the laundry is raised and is then dropped, whereby laundry articles are mingled. In the rolling motion, however, force is continuously applied to the laundry in one direction, whereby possible damage to the laundry is also greater than in the swing motion and the tumbling motion.

In the washing mode, the rotational speed of the washing tub may be set based on the state of laundry. In the washing mode, the rotational speed of the washing tub may be set to be lower for harder laundry such that the rolling motion is performed, and the rotational speed of the washing tub may be set to be higher for softer laundry such that the tumbling motion is performed, in consideration of the washing motion and the relationship between the washing performance and wear degree of laundry.

The washing machine according to the embodiment of the present invention may include a water level sensor (not shown) for sensing the amount of water stored in the water storage tub 3. The controller 60 may control the water supply vale 5 in order to adjust the amount of water that is supplied into the water storage tub 3. The amount of water that is supplied into the water storage tub 3 may be determined based on water level, and the water level may be sensed using the water level sensor provided in the water storage tub. As the water level is increased, the frequency of the water level sensor is decreased. Technology of the water level sensor is well known, and therefore a detailed description thereof will be omitted.

In the case in which the weight of laundry is increased, the washing machine generally supplies an increased amount of water in order to sufficiently wet the laundry. Consequently, the memory 76 may store data about a predetermined reference amount of water supply such that an increased amount of water is supplied into the water storage tub 3 as the weight of laundry is increased.

The wash water level may be changed depending on laundry quality in addition to laundry weight. Since the water content of soft laundry is generally high, it is necessary to supply a large amount of water. In addition, soft laundry may be easily damaged. In the case in which washing is performed in the state in which the wash water level is high, therefore, frictional force generated between the laundry and the inner surface of the drum may be reduced.

Consequently, the controller 60 may control the amount of water supply depending on the state of laundry, and may supply a smaller amount of wash water than the reference amount of water supply for harder laundry.

Hereinafter, a description will be given by way of example with reference to Table 2 and Table 3. The reference amount of water supply may be set to a larger amount as the laundry weight step is changed from level 1 to level 5. In the case in which the laundry weight step is level 1, the amount of wash water that is supplied to the washing tub 4 may be set to a larger amount than the reference amount of water supply such that the water level frequency of the water level sensor is sensed to be low by first deviation of water supply than when the reference amount of water supply is supplied. In the case in which the laundry weight step is level 2, the amount of wash water that is supplied to the washing tub 4 may be set to a larger amount than the reference amount of water supply such that the water level frequency of the water level sensor is sensed to be low by second deviation of water supply than when the reference amount of water supply is supplied.

The first deviation of water supply may be greater than the second deviation of water supply. On the other hand, in the case in which the laundry weight step is level 4 or 5, the amount of wash water that is supplied to the washing tub 4 may be set to a smaller amount than the reference amount of water supply such that the water level frequency of the water level sensor is sensed to be high by fourth or fifth deviation of water supply than when the reference amount of water supply is supplied. The fourth deviation of water supply may be less than the fifth deviation of water supply.

Also, in the case in which the laundry weight step is level 3, the amount of wash water that is supplied to the washing tub 4 may be set to the same amount as the reference amount of water supply.

The washing machine according to the embodiment of the present invention may further include a heater (not shown) for adjusting the temperature of wash water stored in the water storage tub 3. The controller 60 may control the heater in order to adjust the temperature of the wash water.

Alternatively, the water supply valve 5 may include a cold water supply valve (not shown) for adjusting the introduction of cold water into the water storage tub 3 from an external water source and a hot water supply valve (not shown) for adjusting the introduction of hot water into the water storage tub 3 from an external water source. The controller 60 may control the cold water supply valve (not shown) and the hot water supply valve (not shown) in order to adjust the temperature of water that is supplied into the water storage tub 3.

The controller 60 may set the temperature of wash water stored in the water storage tub 3 based on the state of laundry. In the case in which the temperature of water that is supplied is high, the chemical action of detergent may be satisfactorily performed, whereby washing performance may be improved. For soft laundry, however, the danger of damage to the laundry may be increased in the case in which the temperature of water that is supplied is high. For hard laundry, therefore, the temperature of wash water may be set to a high temperature.

Washing cycle time may be generally set to be longer as laundry weight is increased. The memory 76 may store reference time data set to be longer as laundry weight is increased.

The washing cycle time may be changed depending on the state of laundry in addition to laundry weight. In the case in which the washing cycle time is increased, mechanical force, such as frictional force applied to laundry and impact force due to dropping of the laundry, is increased, whereby washing performance is improved. In the case in which the washing cycle time is increased, however, damage to laundry is increased by mechanical force applied to the laundry.

Consequently, the washing cycle time may be set to be longer than reference time set based on laundry weight for harder laundry, and may be set to be shorter than the reference time for softer laundry.

For example, in the case in which the laundry quality step is level 3, the washing cycle time may be set to reference time set based on laundry weight. In the case in which the laundry quality step is level 1, the washing cycle time may be set to be shorter than the reference time. In the case in which the laundry quality step is level 2, the washing cycle time may be set to be shorter than the reference time, and deviation from the reference time may be set to be smaller than in the case of level 1. In the case in which the laundry quality step is level 4, the washing cycle time may be set to be longer than the reference time. In the case in which the laundry quality step is level 5, the washing cycle time may be set to be longer than the reference time, and deviation from the reference time may be set to be greater than in the case of level 4.

In the case in which the motor 9 is continuously operated for a long time, the temperature of the motor may be increased due to overload thereof, which may shorten the lifespan of the motor. In addition, force may be continuously applied to the laundry, whereby the laundry may be further damaged. Consequently, the controller 60 may perform control such that the operation of the motor 9 is paused for a predetermined time and is then operated while the washing cycle is performed.

The controller 60 may control the motor 9 such that the net acting ratio of washing is increased as the wash level is increased. The net acting ratio is a ratio of the operation time of the motor 9 to the sum of the operation time of the motor 9 and the pause time of the motor 9. Hereinafter, the net acting ratio will be referred to as the net acting ratio of washing in order to distinguish from the net acting ratio of circulation, a description of which will follow. That is, the net acting ratio of washing is a ratio of the operation time of the motor to the washing cycle time, and the net acting ratio of circulation is a ratio of the operation time of the circulation pump to the washing cycle time.

In the case in which the net acting ratio of washing is increased, the time during which mechanical force, such as frictional force and impact force due to dropping, is applied to the laundry is increased under the condition of the same washing cycle time, whereby washing performance may be improved and the laundry may be further damaged.

In the washing mode, therefore, the net acting ratio of washing may be set to be higher for harder laundry.

The washing machine according to the embodiment of the present invention may include a pump 11 for pumping the water stored in the water storage tub 3 such that the water is circulated and a nozzle (not shown) configured to spay the water pumped by the pump into the washing tub 4. The pump 11 may be connected to the discharge pipe 12 in order to function as a drainage pump, or may be connected to the nozzle via a circulation pipe in order to function as a circulation pump.

The controller 60 may control the pump 11 such that the water discharged from the water storage tub 3 is sprayed into the washing tub 4 through the nozzle at the time of the washing cycle.

The controller 60 may perform control such that the pump 11 is operated or stopped during the washing cycle. In the case in which the net acting ratio of circulation is higher, the laundry may be wetted by a larger amount of water having detergent dissolved therein, and washing performance may be improved due to the chemical action of the detergent.

In the washing mode, therefore, the net acting ratio of circulation may be set to be higher for harder laundry.

Meanwhile, referring to FIG. 13, the method of controlling the washing machine according to the first embodiment of the present invention includes a washing cycle step at which washing is performed based on a selected washing mode (one of S91 to S95).

The controller 60 may control the motor 9 such that the washing cycle is performed based on the washing motion set by washing mode and the rotational speed of the washing tub. In addition, the controller 60 may control the motor 9, the water supply valve 5, and the pump 11 such that the washing cycle is performed based on the amount of wash water set by washing mode, the temperature of wash water that is supplied, the washing cycle time, the net acting ratio of washing, and the net acting ratio of circulation.

In the above description of the washing mode, a washing mode in which different algorithms are set by laundry weight/laundry quality step has been described by way of example. Unlike this, some laundry weight/laundry quality steps may share a washing mode, and other some laundry weight/laundry quality steps may share another washing mode. Hereinafter, an example of a method of selecting a washing mode based on the weight and state of laundry (S80) and performing washing according to the selected washing mode (S90) will be described with reference to Table 3.

TABLE 3

| Laundry | Laundry weight | | | | |
|---|---|---|---|---|---|
| quality | Level 1 | Level 2 | Level 3 | Level 4 | Level 5 |
| Level 1 | First washing mode | | | Second washing mode | |
| Level 2 | | | | | |
| Level 3 | Third washing mode | | | Fourth washing mode | |
| Level 4 | | | | | |
| Level 5 | Fifth washing mode | | | | |

Referring to Tables 1 to 3, in the case in which the laundry quality is level 1 (the first laundry quality step) or level 2 (the second laundry quality step) and the laundry weight is one of level 1 to level 3, the controller may select a first washing mode (S91). Also, in the case in which the laundry quality is level 1 or level 2 and the laundry weight is level 4 or level 5, the controller may select a second washing mode (S92).

Referring to Table 2, in the case in which the state of laundry is level 1 or level 2, the laundry introduced into the washing tub 4 is soft laundry, which is easily worn by washing, and therefore it is necessary to perform washing according to a washing algorithm in which the laundry is not damaged. In addition, since such laundry is relatively little contaminated in many cases, relatively high washing performance is not required.

In the first washing mode (S91), therefore, the washing tub may be rotated at a rotational speed at which a washing motion capable of reducing damage to laundry is realized, compared to other washing modes. Also, in the first washing mode (S91), a washing algorithm may be set to have relatively low temperature of wash water, short washing cycle time, low net acting ratio of washing, and low net acting ratio of circulation. The net acting ratio of washing is a ratio of the operation time of the motor to the washing cycle time, and the net acting ratio of circulation is a ratio of the operation time of the circulation pump to the washing cycle time. In addition, the first washing mode may be set to supply a larger amount of wash water than the reference amount of water supply set based on the weight of laundry.

When the first washing mode is selected, washing is performed according to an algorithm of the first washing mode (S91).

In the case in which the state of laundry is level 1 or level 2 and the weight of laundry is large (level 4 or level 5), the controller 60 may select the second washing mode (S92). The second washing mode may be set to have an algorithm suitable to wash a larger weight of laundry than in the first washing mode.

In the case in which washing is performed in the state in which the second washing mode is set to have the same washing algorithm as the first washing mode, the weight of laundry is large, whereby washing performance may be reduced. In the second washing mode, therefore, the washing tub may be rotated at a rotational speed at which a washing motion having higher washing performance than in the first washing mode is realized. Also, in the second washing mode, a washing algorithm may be set to have higher temperature of wash water, longer washing cycle time, higher net acting ratio of washing, and higher net acting ratio of circulation than in the first washing mode.

The second washing mode may be set to supply a larger amount of wash water than the reference amount of water supply set based on the weight of laundry. In addition, the reference amount of water supply in the second washing mode may be larger than the reference amount of water supply in the first washing mode, whereby the second washing mode may be set to supply a larger amount of wash water than in the first washing mode.

When the second washing mode is selected, washing is performed according to an algorithm of the second washing mode (S92).

Laundry having a laundry quality of level 3 or level 4 (the third or fourth laundry quality step) may less damaged by washing and further contaminated than laundry having a laundry quality of level 1 or level 2. In a third washing mode, therefore, the washing tub may be rotated at a rotational speed at which a washing motion having higher washing performance than in the first and second washing modes is realized. Also, in the third washing mode, a washing algorithm may be set to have higher temperature of wash water, longer washing cycle time, higher net acting ratio of washing, and higher net acting ratio of circulation than in the first and second washing modes. In addition, the algorithm may be set to supply a smaller amount of wash water than in the first washing mode.

When the third washing mode is selected, washing is performed according to the algorithm of the third washing mode (S93).

In the case in which the state of laundry is level 3 or level 4 and the weight of laundry is large (level 4 or level 5), the controller 60 may select a fourth washing mode. The fourth washing mode may be set to have an algorithm suitable to wash a larger weight of laundry than in the third washing mode.

In the fourth washing mode, therefore, the washing tub may be rotated at a rotational speed at which a washing motion having higher washing performance than in the third washing mode is realized for the same reason as what is described in the second washing mode. Also, in the fourth washing mode, a washing algorithm may be set to have higher temperature of wash water, longer washing cycle time, higher net acting ratio of washing, and higher net acting ratio of circulation than in the third washing mode. In addition, the algorithm may be set to supply a smaller amount of wash water than in the second washing mode.

When the fourth washing mode is selected, washing is performed according to the algorithm of the fourth washing mode (S94).

In the case in which the state of laundry is level 5 (the fifth laundry quality step), the laundry introduced into the washing tub 4 is coarse laundry, damage to which is not of concern.

In the case in which the state of laundry is level 5, therefore, the controller 60 may select a fifth washing mode irrespective of laundry weight. In the fifth washing mode, a washing algorithm having higher washing performance than in the other washing modes may be set. In the fifth washing mode, the washing tub may be rotated at a rotational speed at which a washing motion having higher washing performance than in the other washing modes is realized. Also, in the fifth washing mode, a washing algorithm may be set to have higher temperature of wash water, longer washing cycle time, higher net acting ratio of washing, and higher net acting ratio of circulation than in the other washing modes. In addition, the algorithm may be set to supply a smaller amount of wash water than the reference amount of water supply, and the algorithm may be set such that the difference between the reference amount of water supply and the amount of wash water that is supplied is greater than in the other washing modes.

When the fifth washing mode is selected, washing is performed according to the algorithm of the fifth washing mode (S95).

The above description of the washing modes is merely an illustration for easy understanding.

After the washing cycle according to the selected washing mode (S90) is finished, the wash water may be drained (S100), and then a rinsing cycle (S110) and a spin-drying cycle (S120) may be performed for a predetermined cycle time based on laundry weight and/or the state of laundry.

Hereinafter, the method of controlling the washing machine according to the second embodiment of the present invention will be described with reference to FIGS. 12 and 14.

The method of controlling the washing machine according to the second embodiment of the present invention is different from the method of controlling the washing machine according to the first embodiment of the present invention in that a step of determining the state of laundry using the artificial neural network is performed a plurality of times and in that the state of the laundry is finally obtained based on the state of the laundry determined the plurality of times.

That is, in this embodiment, a laundry weight sensing step (S210), a water supply step (S220), and a laundry wetting step (S230) are identical to S10, S20, and S30, respectively, and a first sensing step (S240) is identical to S40 to S70.

The method of controlling the washing machine according to the second embodiment of the present invention further includes a second sensing step (S250) of redetermining the state of laundry received in the washing tub 4 using the artificial neural network after the first sensing step (S240).

The second sensing step (S250) is a step of redetermining the state of laundry according to an algorithm having the same construction as the first sensing step after the first sensing step (S240). That is, the second sensing step (S250) includes a second acceleration step of rotating the washing tub 4 while accelerating the washing tub, a step of obtaining a second current value supplied to the motor 9 in a second acceleration period in which the washing tub 4 is rotated while being accelerated at the second acceleration step, and a step of determining the state of laundry from output of the output layer of the artificial neural network using the second current value as input data of the artificial neural network.

The method of controlling the washing machine according to the second embodiment of the present invention may include a step (S260) of obtaining the state of laundry based on first laundry quality, which is the state of laundry determined at the first sensing step (S240), and second laundry quality, which is the state of laundry determined at the second sensing step (S250), after the second sensing step (S250).

Hereinafter, the method of obtaining the state of laundry based on the first laundry quality and the second laundry quality (S260) will be described with reference to Table 2 and Table 4 below.

TABLE 4

| | Laundry quality average | | | | | | | | |
|---|---|---|---|---|---|---|---|---|---|
| | 1 | 1.5 | 2 | 2.5 | 3 | 3.5 | 4 | 4.5 | 5 |
| Final determination | 1 | 1 | 2 | 2 | 3 | 3 | 4 | 5 | 5 |

In the case in which the first laundry quality determined at the first sensing step is level 1 (the first laundry quality step) and the second laundry quality determined at the second sensing step is level 1, the laundry quality average may be level 1. In the case in which the first laundry quality is level 1 and the second laundry quality is level 2 (the second laundry quality step), the laundry quality average may be level 1.5. In this way, the arithmetic mean of the first laundry quality and the second laundry quality may be defined as the laundry quality average.

Referring to Table 4, in the case in which the laundry quality average is level 1.5, i.e. in the case in which the state of the laundry is determined to be level 1 at a sensing step and the state of the laundry is determined to be level 2 at another sensing step, the laundry received in the washing tub 4 is laundry, the wear degree of which is more important than the washing performance thereof. In this case, therefore, the state of the laundry is finally determined to be the first laundry quality step.

In the same manner, in the case in which the laundry quality average is level 2.5, the state of the laundry is finally determined to be the second laundry quality step.

Also, the state of the laundry is determined to be level 2 at a sensing step and the state of the laundry is determined to be level 5 at another sensing step, the laundry quality average is level 3.5. In this case, the state of the laundry may be level 2. In the case in which such laundry is washed according to a washing mode set based on the fifth laundry quality step, the laundry may be damaged.

A problem in which washing performance is low may be solved through rewashing, but a problem in which laundry is damaged is not easily solved. In the case in which the laundry quality average is level 3.5, therefore, the state of the laundry is determined to correspond to the third laundry quality step.

Meanwhile, in the case in which the laundry quality average is level 4.5, i.e. in the case in which the state of the laundry is determined to be level 4 at a sensing step and the state of the laundry is determined to be level 5 at another sensing step, the laundry received in the washing tub 4 is laundry, the washing performance of which is more important than the wear degree thereof. In this case, therefore, the state of the laundry is finally determined to correspond to the fifth laundry quality step.

That is, in the case in which the wear degree of the laundry is important, the state of the laundry may be finally determined after the decimal point is omitted, and, in the case in which the washing performance of the laundry is important, the state of the laundry may be finally determined after the decimal point is raised.

A washing mode is selected depending on the state of laundry obtained based on the first laundry quality and the second laundry quality (S280), and washing is performed according to the selected washing mode (S290).

After the washing according to the selected washing mode (S290) is finished, the wash water may be drained (S300), and then a rinsing cycle (S310) and a spin-drying cycle (S320) may be performed for a predetermined cycle time based on laundry weight and/or the state of laundry.

Although the above description has been made by way of example based on a front load type washing machine, in which the washing tub 4 is rotated about a substantially horizontal axis, the washing machine according to the present invention and the method of controlling the same may be applied to a top load type washing machine.

Meanwhile, the method of controlling the washing machine according to the embodiment of the present invention may be implemented as code that can be written on a processor-readable recording medium and thus read by a processor. The processor-readable recording medium may be any type of recording device in which data is stored in a processor-readable manner. The processor-readable recording medium may include, for example, read only memory (ROM), random access memory (RAM), compact disc read only memory (CD-ROM), magnetic tape, a floppy disk, and an optical data storage device, and may be implemented in the form of a carrier wave transmitted over the Internet. In addition, the processor-readable recording medium may be distributed over a plurality of computer systems connected to a network such that processor-readable code is written thereto and executed therefrom in a decentralized manner.

As is apparent from the above description, the washing machine according to the present invention and the method of controlling the same are capable of analyzing the current pattern of a motor using an artificial neural network based on machine learning. In particular, the current pattern is changed depending on the state of laundry in a washing tub, and various characteristics of the laundry, such as laundry weight, laundry quality, and laundry movement, are reflected in the current pattern. Consequently, it is possible to accurately and rapidly classify the laundry using the current pattern as input data of the artificial neural network constructed through training based on machine learning.

In particular, the classification of the laundry by characteristic is possible based on various criteria, such as the material of the laundry, the water content of the laundry, and the volumetric difference between dry laundry and wet laundry, in addition to the laundry weight. In addition, accuracy may be further improved with accumulation of training data (motor current data) of machine learning.

In addition, one of a plurality of washing modes classified in consideration of the wear degree of laundry and/or washing strength may be selected based on the state of the laundry, and washing may be performed according to the selected washing mode, whereby it is possible to reduce damage to the laundry and to improve washing performance.

It should be noted that effects of the present invention are not limited to the effects of the present invention as mentioned above, and other unmentioned effects of the present invention will be clearly understood by those skilled in the art from the following claims.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

What is claimed is:

1. A method of controlling a washing machine, the method comprising:

determining a state of laundry received in a washing tub, from an output of an output layer of a pre-trained machine-learning network based on an input to an input layer of the machine-learning network that comprises an electrical current value supplied to a motor configured to rotate the washing tub during accelerated rotation of the washing tub, wherein the electrical current value is obtained in a first sensing operation;

selecting, based on the state of the laundry, one of a plurality of washing modes that are classified in consideration of (i) a wear degree of the laundry or (ii) a washing strength of the laundry; and performing a washing cycle operation that comprises washing the laundry according to the selected washing mode.

2. The method according to claim 1, wherein the first sensing operation comprises:

determining the state of the laundry to be one of a plurality of laundry quality levels that are classified in consideration of a hardness of the laundry.

3. The method according to claim 1, wherein, in the selected washing mode, a rotational speed of the washing tub is set based on the state of the laundry.

4. The method according to claim 3, wherein, in the selected washing mode, the rotational speed of the washing tub is set to be lower based on the state of the laundry being harder.

5. The method according to claim 1, wherein the first sensing operation comprises obtaining a weight of the laundry that is received in the washing tub, from the output of the output layer of the machine-learning network based on the electrical current value as the input to the machine-learning network.

6. The method according to claim 1, further comprising performing a laundry weight sensing operation that comprises:

obtaining a weight of the laundry that is received in the washing tub before performing the first sensing operation.

7. The method according to claim 6, wherein, in the selected washing mode, an amount of wash water that is supplied to the washing tub is set based on (i) the state of the laundry and (ii) the weight of the laundry.

8. The method according to claim 6, wherein, in the selected washing mode, a washing cycle time is set based on (i) the state of the laundry and (ii) the weight of the laundry.

9. The method according to claim 1, wherein, in the selected washing mode, a temperature of wash water that is supplied to the washing tub is set based on the state of the laundry.

10. The method according to claim 1, further comprising:

in the selected washing mode, setting, based on the state of the laundry, a ratio of time during which the motor is operated in the washing cycle operation relative to a washing cycle time.

11. The method according to claim 1, wherein the washing cycle operation comprises operating a pump that is configured to circulate wash water such that the wash water is sprayed into the washing tub through a nozzle, and wherein the method further comprises:

in the selected washing mode, setting, based on the state of the laundry, a ratio of time during which the pump is operated in the washing cycle operation relative to a washing cycle time.

12. The method according to claim 1, wherein the first sensing operation comprises:

performing a first acceleration operation that comprises rotating the washing tub while accelerating the washing tub;

obtaining a first electrical current value that is supplied to the motor during a first acceleration period in which the washing tub is rotated while being accelerated; and determining the state of the laundry from the output of the output layer of the machine-learning network using the first electrical current value as the input to the machine-learning network.

13. The method according to claim 1, further comprising:

performing a second sensing operation of re-determining the state of the laundry received in the washing tub using the machine-learning network after performing the first sensing operation, wherein the second sensing operation comprises:

performing a second acceleration operation of rotating the washing tub while accelerating the washing tub;

obtaining a second electrical current value that is supplied to the motor in a second acceleration period in which the washing tub is rotated while being accelerated; and determining the state of the laundry from the output of the output layer of the machine-learning network using the second electrical current value as the input of the machine-learning network.

14. The method according to claim 13, further comprising obtaining, after the second sensing operation, the state of the laundry based on (i) a first laundry quality, which is the state of the laundry determined at the first sensing operation, and (ii) a second laundry quality, which is the state of the laundry determined at the second sensing operation.

15. The method according to claim 14, wherein selecting the washing mode comprises:

selecting the washing mode based on the state of the laundry that is obtained based on (i) the first laundry quality and (ii) the second laundry quality.

16. A method of controlling a washing machine, the method comprising:

accelerating a washing tub having laundry introduced thereinto;

obtaining an electrical current value that is supplied to a motor configured to rotate the washing tub in a period in which the washing tub is rotated while being accelerated;

obtaining a state of the laundry that is received in the washing tub, from an output of an output layer of a pre-trained machine-learning based on an input to an input layer of the machine-learning network that comprises the electrical current value; and performing a washing cycle operation that comprises washing the laundry according to a washing mode that is determined based on the state of the laundry.

17. A washing machine comprising:

a washing tub configured to receive laundry, the washing tub being configured to be rotatable;

a motor configured to rotate the washing tub;

a controller configured to control the motor such that the washing tub is rotated while being accelerated; and a current sensing unit configured to sense an electrical current value of the motor, wherein the controller is configured to:

determine a state of laundry received in the washing tub, from an output of an output layer of a pre-trained machine-learning network based on an input to an input layer of the machine-learning network that comprises an electrical current value supplied to the motor during accelerated rotation of the washing tub;

selecting, based on the state of the laundry, one of a plurality of washing modes that are classified in consideration of (i) a wear degree of the laundry or (ii) a washing strength of the laundry; and performing a washing cycle operation that comprises washing the laundry according to the selected washing mode.

* * * * *